US007027363B2

(12) United States Patent
Kawaguchi

(10) Patent No.: US 7,027,363 B2
(45) Date of Patent: Apr. 11, 2006

(54) TIME MEASUREMENT SYSTEM AND METHOD OF CONTROLLING THE SAME

(75) Inventor: Takashi Kawaguchi, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 206 days.

(21) Appl. No.: 10/460,556

(22) Filed: Jun. 11, 2003

(65) Prior Publication Data

US 2004/0042345 A1 Mar. 4, 2004

(30) Foreign Application Priority Data

Jun. 12, 2002 (JP) ..... 2002-171557

(51) Int. Cl.
*G04C 11/02* (2006.01)

(52) U.S. Cl. ..... 368/47; 368/187

(58) Field of Classification Search ..... 368/46, 368/47, 59, 187, 200; 340/310.06, 310.07
See application file for complete search history.

(56) References Cited

U.S. PATENT DOCUMENTS

| | | | | |
|---|---|---|---|---|
| 4,490,050 | A * | 12/1984 | Singhi | 368/46 |
| 5,677,895 | A | 10/1997 | Mankovitz | |
| 5,805,530 | A * | 9/1998 | Youngberg | 368/47 |
| 6,236,623 | B1 * | 5/2001 | Read et al. | 368/46 |
| 6,288,977 | B1 * | 9/2001 | Yoshida et al. | 368/47 |
| 6,377,517 | B1 | 4/2002 | Tursich | |
| 6,525,995 | B1 * | 2/2003 | Diehl et al. | 368/47 |
| 6,623,157 | B1 * | 9/2003 | Fujisawa et al. | 368/187 |
| 2002/0171400 | A1 | 11/2002 | Koyama et al. | |

FOREIGN PATENT DOCUMENTS

| | | |
|---|---|---|
| EP | 1 087 269 A1 | 3/2001 |
| EP | 1 143 309 A1 | 10/2001 |
| JP | 51-109874 | 9/1976 |
| JP | 54-079680 | 6/1979 |
| JP | 54-087264 | 7/1979 |
| JP | 06-076895 | 3/1994 |
| JP | 6-331762 | 12/1994 |
| JP | 09-113647 | 5/1997 |
| JP | 11-084028 | 3/1999 |
| JP | 11-211857 | 8/1999 |
| JP | 2000-221285 | 8/2000 |
| JP | 2001-305248 | 10/2001 |
| JP | 2002-148371 | 5/2002 |

* cited by examiner

*Primary Examiner*—Andrew H. Hirshfeld
*Assistant Examiner*—Leo T. Hinze
(74) *Attorney, Agent, or Firm*—Mark P. Watson

(57) ABSTRACT

A time measurement system includes a master timepiece and a slave timepiece 3. The master timepiece includes a time signal generating circuit that receives a standard frequency and time signal and generates a time signal being receivable by a motor driving coil 35 of the slave timepiece 3; and a transmitter circuit and a coil that transmit this signal. The slave timepiece 3 includes a time counter 33 that keeps time on the basis of a reference signal; a driving motor with the driving coil 35; a receiver circuit 37 that receives the time signal using the driving coil 35; a control circuit 38 that corrects the time counter 33 on the basis of the received time signal; and a time display unit 36 that displays time. Since the driving coil 35 is used, increases in the number of components and cost are suppressed. The time can be adjusted within a short period of time. Waterproof abilities are improved.

14 Claims, 23 Drawing Sheets

TIME MEASUREMENT SYSTEM AND METHOD OF CONTROLLING THE SAME

TECHNICAL FIELD

The present invention relates to time measurement systems and methods of controlling the same.

BACKGROUND ART

As one type of radio-controlled timepiece that receives an external LF standard frequency and time signal and corrects the time, a master-slave time measurement system including a master timepiece that receives the LF standard frequency and time signal and a slave timepiece that communicates with the master timepiece via radio waves or electrodes and corrects the time on the slave timepiece is disclosed (see Japanese Unexamined Patent Application Publication No. 54-79680, Japanese Unexamined Patent Application No. 6-331762, etc.)

In such a master-slave radio-controlled time measurement system, the slave timepiece is often a watch. Specifically, in a place such as outdoors where the radio reception state is satisfactory, a radio-controlled watch receives a standard frequency and time signal using a built-in antenna and corrects the time.

On the other hand, in a building such as an apartment building or a steel-frame building where the reinforcing steel or steel frame functions as a shield and it is thus very difficult to receive radio waves indoors, the master timepiece is placed at a specific position such as a position near a window, at which radio waves can be received. This master timepiece receives an external standard frequency and time signal, whereas the slave timepiece receives radio waves emitted from the master timepiece and corrects the time.

In contrast, in the case of master and slave timepieces connected via electrodes, the master timepiece is placed at a position at which an external standard frequency and time signal can be received even being in the room. In order to correct the time on the slave timepiece, a terminal (electrode) of the slave timepiece is connected to a terminal (electrode) of the master timepiece. The master timepiece sends a time signal to the slave timepiece to adjust the time.

In such a master-slave radio-controlled time measurement system, the slave timepiece needs an antenna and an electrode to receive time information from the master timepiece. Compared with a general timepiece, the number of components is increased, and the configuration becomes more complex. As a result, cost is increased.

In order to provide the slave timepiece with an antenna, since the master timepiece emits the same signal as the external LF standard frequency and time signal, the slave timepiece must include a relatively large antenna capable of receiving such an LF standard frequency and time signal. Particularly in the case of a watch, reduction in size is difficult. In the case of an LF standard frequency and time signal, the length of one time signal (frame) is 60 seconds. When signals of two to three frames are to be received to determine whether the correct time signal is received, it takes approximately two to three minutes only to receive the signals. It thus requires time to adjust the time.

When the master timepiece and the slave timepiece have corresponding electrodes, the electrodes are exposed to the outside. As a result, their waterproof abilities become degraded. A watch or the like must include covers for the electrodes. As a result, the number of components is increased, and cost is further increased.

An object of the present invention is to provide a time measurement system including such master-slave timepieces in which increases in the number of components and cost are suppressed, the time is adjusted within a short period of time, and waterproof abilities of the master-slave timepieces are improved, and to provide a method of controlling the same.

DISCLOSURE OF INVENTION

A time measurement system of the present invention includes a master station capable of receiving external time data and outputting a time signal on the basis of this time information and a slave station that receives the time signal from the master station and corrects the time on the basis of this time information. The slave station includes a reference signal generating circuit that generates a reference signal; a timekeeping circuit that keeps time on the basis of the reference signal; a driving motor with a driving coil; a receiver circuit that is connected to the driving coil and that receives the time signal using the driving coil as a receiving coil; a control circuit that corrects the time kept by the timekeeping circuit on the basis of the time signal received by the receiver circuit; and a time display unit that displays the time kept by the timekeeping circuit. The master station includes a time data receiver capable of receiving the time data; a time signal generating circuit that generates a time signal on the basis of the received time data, the time signal being receivable by the driving coil of the slave station; a transmitter circuit and a communication coil that transmit the time signal; and a control circuit that controls the operation of the time data receiver, the time signal generating circuit, and the transmitter circuit.

The time data receiver of the master station may be a unit capable of receiving time data using radio waves including a time code, such as an LF standard frequency and time signal or GPS satellite waves, or a unit capable of receiving time data transmitted via a network or the like.

According to the present invention, since the master station receiving an LF standard frequency and time signal, GPS satellite waves, or time data transmitted via a network or the like has the time signal generating circuit, the master station can output a time signal that can be received by the motor driving coil of the slave station. In the slave station, the driving coil also serves as a receiving antenna. Compared with a slave station including an additional receiving antenna, the number of components is reduced, and cost is reduced.

Since the time signal generating circuit can generate a time signal whose frequency and a time code format differ from those of received data, such as a standard frequency and time signal, the length of the time signal (data length) can be reduced to a shorter length than that of, for example, a known LF standard frequency and time signal, in which one piece of time information is represented by a one-minute signal. The time is thus adjusted within a short period of time. Since the time signal can be transmitted and received between the master station and the slave station using radio waves, electrodes or the like need not be provided. Therefore, waterproof abilities are improved.

The format of the time signal generated by the time signal generating circuit may include, for example, six numbers, each two digits representing hours, minutes, and seconds. These six numbers are serially transmitted in a predetermined sequence. Since one number (0 to 9) is represented by a three-bit digital signal, six numbers are represented by a binary code consisting of at least 18 bits. In this case, when the time signal is transmitted on, for example, a 256-Hz carrier, one time signal is transmitted in $^{18}/_{256}$=approximately 0.07 sec. The transmission is processed in a very short period of time.

Preferably, the time data receiver of the master station includes a receiver circuit capable of receiving radio waves including a time code, the external time data being time data based on the time code included in the radio waves.

With this arrangement, the external time data received by the master station includes various radio waves, such as a standard frequency and time signal. Use of radio waves reduces restriction on the position at which the master station is installed, compared with a wired installation using a network or the like. Therefore, the freedom of installing timepiece is inceased.

Preferably, the time display unit of the slave station includes time-displaying hands connected to the driving motor via a gear train, the driving motor being driven by a motor driving circuit that outputs a motor drive pulse in response to the timekeeping by the timekeeping circuit.

With the time-displaying hands, the slave station may be used as a general analog quartz timepiece. Since reception is done using the motor driving coil, the slave station can be implemented by adding only a receiver circuit or the like to such a general analog quartz timepiece. Since this receiver circuit can be incorporated in a timepiece IC or the like, there is no increase in the number of components. The slave station is thus offered at low price.

Preferably, the slave station includes a transmitter circuit that is connected to the driving coil and that transmits a signal using the driving coil as a transmitting coil; and a control circuit that controls the transmitter circuit to transmit, via the driving coil, a receipt acknowledgement signal indicating that the time signal is received by the receiver circuit. Preferably, the master station includes a receiver circuit connected to the communication coil; reception result displaying means; and a control circuit that controls the reception result,displaying means to perform predetermined display when the receipt acknowledgement signal from the slave station is received by the receiver circuit.

With this arrangement, upon reception of the time signal, the slave station transmits a receipt acknowledgement signal confirming the reception of the time signal to the master station, and the reception result displaying means of the master station performs predetermined display. This enables a user to easily determine that the time signal is received successfully. The user will never be required to use a timepiece that has failed to adjust the time due to a failure in reception of the time signal. The time is adjusted reliably.

Preferably, the slave station includes reception result displaying means; and a control circuit that controls the reception result displaying means to perform predetermined display when the time signal is received by the receiver circuit.

With this arrangement, the user reliably determines at the slave station side that the time signal is received. The time is thus adjusted reliably.

Preferably, the reception result displaying means includes a liquid crystal display, and the control circuit controls the liquid crystal display to display a predetermined symbol representing the reception result.

Specifically, each of the master station and the slave station includes a liquid crystal display serving as the reception result displaying means. The successful reception of the time signal is indicated by displaying a predetermined symbol representing the reception result (including various symbols, such as a mark, e.g., a "star", or characters, e.g., "received") on this liquid crystal display.

Use of the liquid crystal display simplifies control of displaying the reception result and makes it easy for the user to know the reception result. The liquid crystal display may additionally display time, thus enabling the master station or the slave station to be used as a digital timepiece.

Preferably, the reception result displaying means includes hands, and the control circuit controls the hands to display the reception result by driving the hands to move differently from normal hand movement.

Specifically, each of the master station-and the slave station includes hands. These hands are moved differently from normal hand movement. For example, the second hand is continuously moved by two seconds (two steps) and stopped for two seconds. This two-step hand movement may be repeated to display the reception result.

With this arrangement, when the master station or the slave station includes an analog timepiece, its hands may be used. It thus becomes unnecessary to additionally include a liquid crystal display or the like to display the reception result. Therefore, the number of components is reduced, resulting in space savings.

Preferably, the master station includes input means, and the control circuit controls the transmitter circuit to transmit the time signal only when there is an input to the input means.

With this arrangement, the transmission of the time signal by the master station is suppressed to minimum. Compared with the constant transmission of the time signal, the power consumption of the master station is reduced, resulting in extension of duration of the master station.

Preferably, the slave station includes input means, and the control station controls the receiver circuit to receive the time signal only when there is an input to the input means.

With this arrangement, the reception of the time signal by the slave station is suppressed to minimum. Compared with the constant reception of the time signal, the power consumption of the slave station is reduced, resulting in extension of duration of the slave station.

Preferably, the control circuit of the master station controls the transmitter circuit to transmit the time signal so that the transmission time of the time signal does not overlap a time at which the motor drive pulse of the slave station is output.

For example, the master station includes a coil and a receiver circuit capable of detecting the motor drive pulse of the slave station. The control circuit controls the transmitter circuit to transmit the time signal in response to the detection of the motor drive pulse.

With this arrangement, the time signal is reliably received without being hindered by the motor drive pulse only by activating the receiver circuit of the slave station for a period during which no motor drive pulse is output. The slave station does not need a synchronization circuit or the like to receive the time signal. The configuration of the slave station is simplified, and the time is reliably adjusted.

Preferably, the control circuit of the master station controls the transmitter circuit to transmit the time signal twice or more every second, the transmission interval between the time signals being greater than or equal to the pulse width of the motor drive pulse of the slave station.

With this arrangement, even when the transmission time of one time signal overlaps the output time of one motor drive pulse (one motor drive pulse is output every second), the subsequent time signal is transmitted without overlapping the drive pulse since the output of the drive pulse is completed before the subsequent time signal is output. At least one time signal is transmitted every second at a time differing from a time at which the drive pulse is output even when the output time of the motor drive pulse is not detected by the control circuit of the master station. Therefore, the slave station reliably receives the time signal. The configuration and control of not only the slave station, but also the master station are simplified, and cost is reduced.

Preferably, the control circuit of the master station controls the transmitter circuit to transmit the time signal three times or more every second.

The pulse width of one motor drive pulse output every second is at most (less than or equal to) ⅓ sec, which is generally approximately 0.1 sec. When the time signal is output three times or more every second, at least one time signal is transmitted without overlapping the motor drive pulse. The slave station reliably receives at least one time signal every second even when the control circuit of the master station does not detect the output time of the motor drive pulse. The configuration and control of not only the slave station, but also the master station are simplified, and cost is reduced.

A present invention is a method of controlling a time measurement system including a master station and a slave station. The control method includes a receiving step of receiving, by the master station, external time data; a time signal generating step of generating a time signal on the basis of the time data received in the reception step, the time signal being receivable by a driving coil of a driving motor of the slave station; a transmitting step of transmitting the time signal from a communication coil of the master station; a reception step of receiving the time signal using the driving coil of the slave station; and a time correcting step of correcting time kept by the slave station on the basis of the received time signal.

According to this control method, the operation and advantages similar to those of the above-described time measurement system are achieved. Specifically, in the slave station, the driving coil also serves as a receiving antenna. Compared with a slave station including an additional receiving antenna, the number of components is reduced, and cost is reduced. Since a time signal whose frequency and a time code format differ from those of received data can be generated, the length of the time signal can be reduced to a shorter length than that of a known LF standard frequency and time signal, in which one piece of time information is represented by a one-minute signal. The time is thus adjusted within a short period of time. Since the time signal can be transmitted and received between the master station and the slave station using radio waves, electrodes or the like need not be provided. Therefore, waterproof abilities are improved.

BEST MODE FOR CARRYING OUT THE INVENTION

To describe the present invention in more detail, the present invention will be described with reference to the accompanying drawings.

[First Embodiment]

Figure 1:
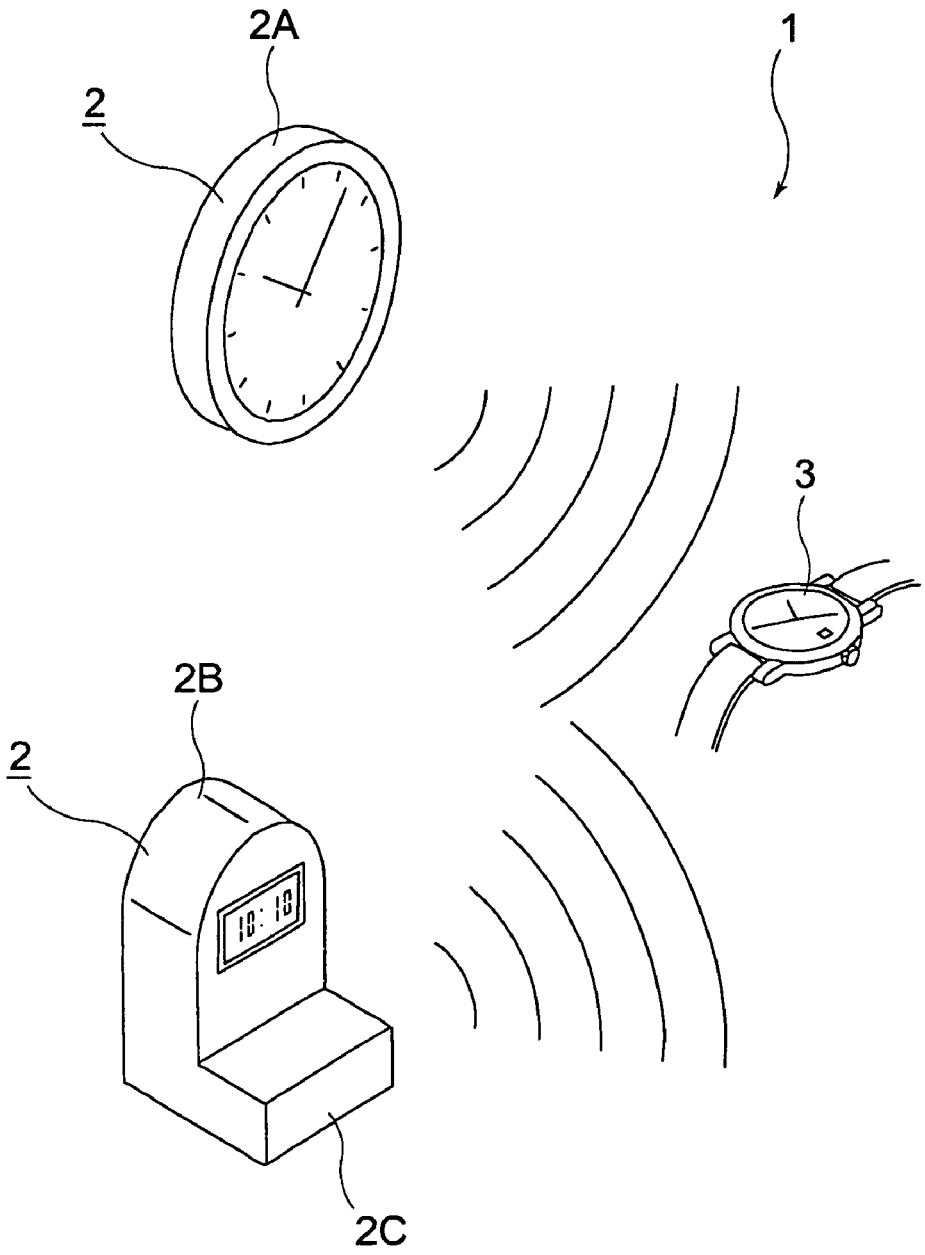
FIG. 1 is a schematic diagram showing the operating state according to a first embodiment of the present invention.

A time measurement system 1 of a first embodiment includes, as shown in FIG. 1, a master timepiece 2 serving as a master station and a slave timepiece 3 serving as a slave station.

The master timepiece 2 includes a clock, such as a wall clock 2A or a stand clock 2B. The slave timepiece 3 includes a watch, such as a wristwatch or a pocket watch, although the slave timepiece 3 may be a clock.

Figure 2:
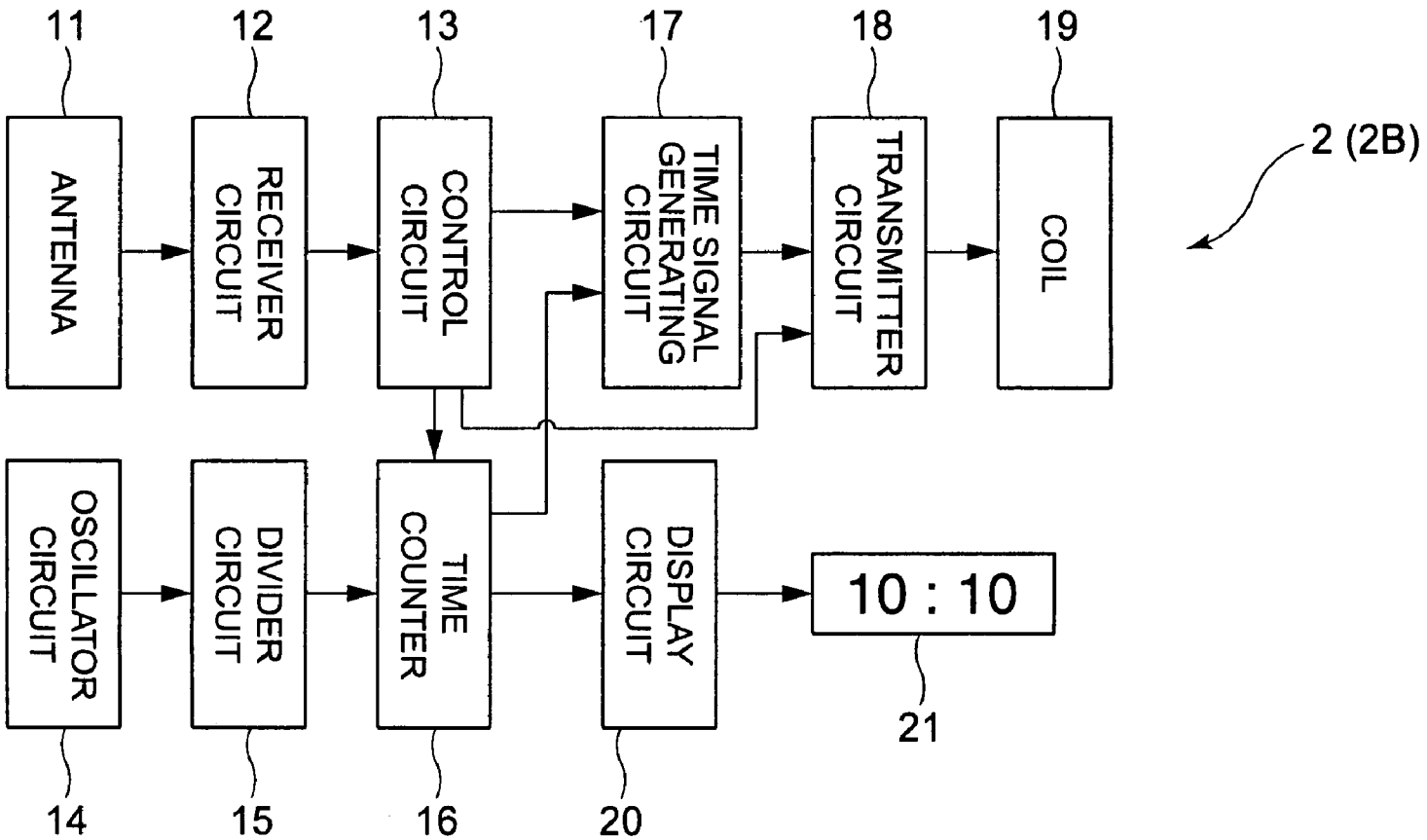
FIG. 2 is a block diagram showing the configuration of a master timepiece of the first embodiment.
Figure 3:
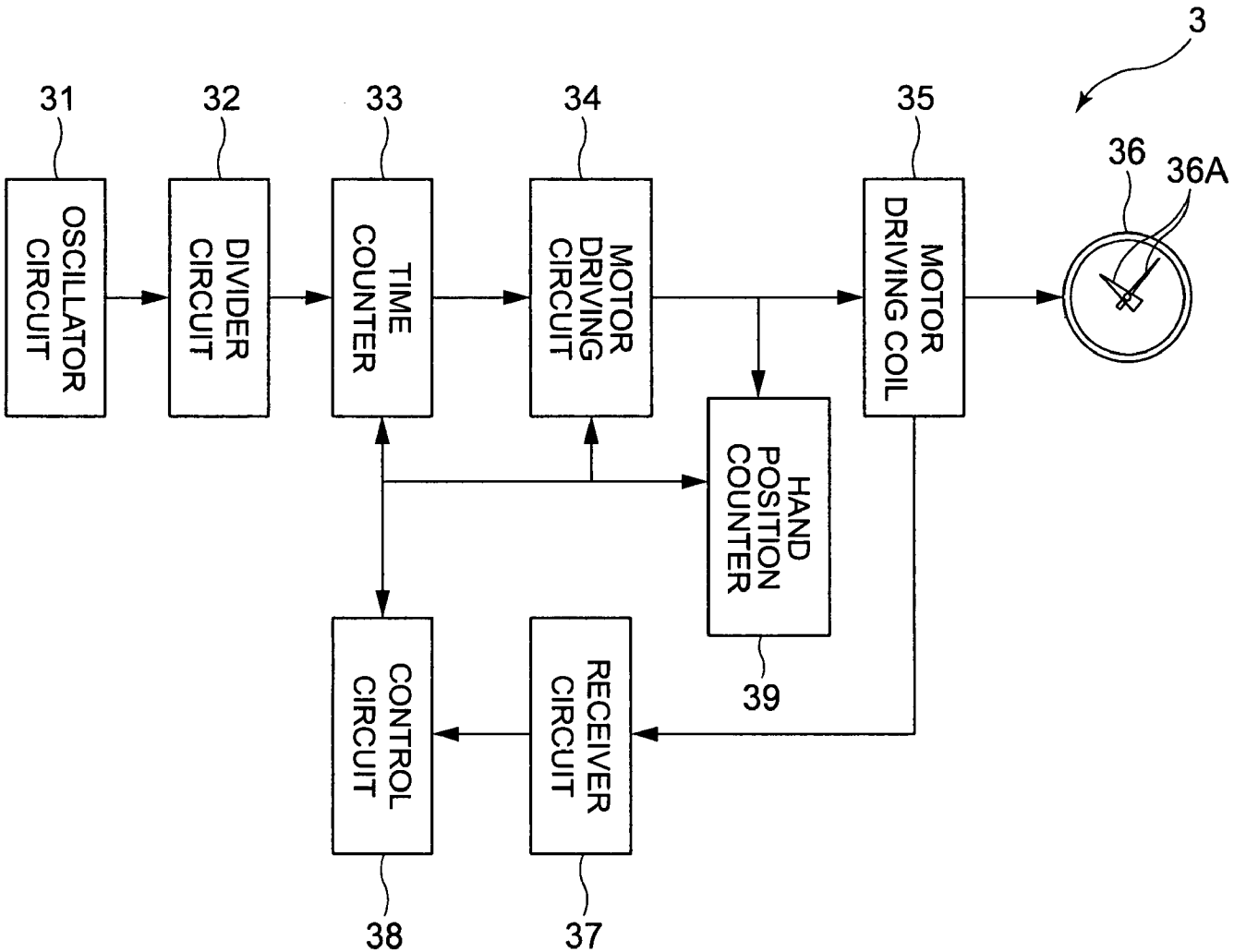
FIG. 3 is a block diagram showing the configuration of a slave timepiece of the first embodiment.

FIGS. 2 and 3 are block diagrams of the configuration of the master timepiece 2 (stand clock 2B) and the configuration of the slave timepiece 3, respectively. The master timepiece 2 has the functions of a digital-display radio-controlled timepiece and a transmission function of transmitting a time signal.

Specifically, the master timepiece 2 includes an antenna 11, a receiver circuit 12 serving as a time data receiver, a control circuit 13, an oscillator circuit 14, a divider circuit 15, a time counter 16, a time signal generating circuit 17, a transmitter circuit 18, a coil 19, a display circuit 20, and a time display unit 21.

Figure 4:
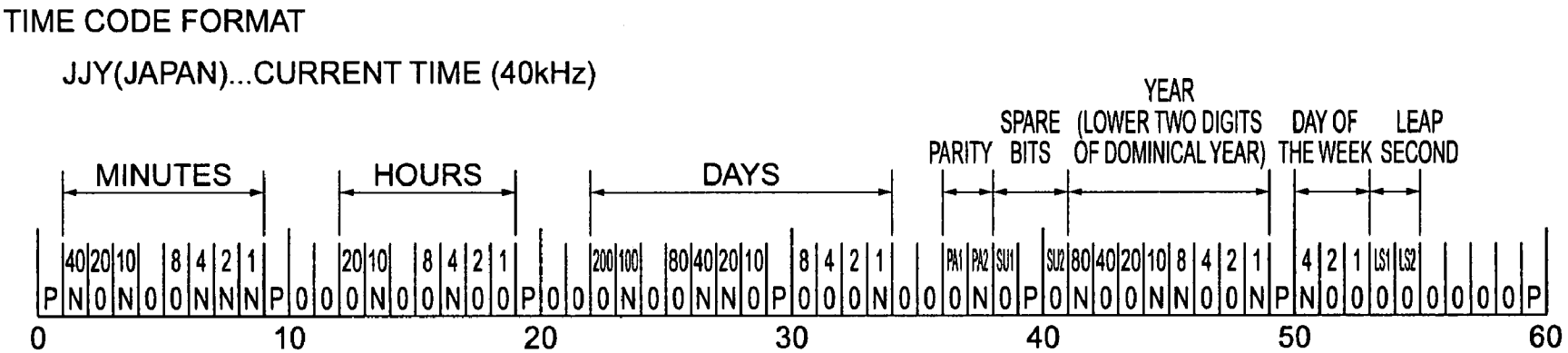
FIG. 4 is a diagram showing a time code format of an LF standard frequency and time signal.

The antenna 11 includes a ferrite antenna or the like and can receive an LF standard frequency and time signal on which time information is superimposed. The LF standard frequency and time signal (JJY) has a time code format shown in FIG. 4. This time code format shows that one signal is transmitted every second and that one record is transmitted in 60 seconds. In other words, data for one frame has 60 bits. The time code format of the LF standard frequency and time signal includes the following items: minutes and hours of the current time, days from January 1st of the current year, year (lower two digits of the dominical year), day of the week, and leap second. The value in each item includes a combination of numeric values allocated to each second. Whether this combination is turned ON or OFF is determined by the type of a signal. In the diagram, "P" indicates a position marker, which is a signal whose position is determined in advance; "N" indicates that the corresponding item is turned ON and thus to be added; and "O" indicates that the corresponding item is turned OFF and not to be added.

In Japan, the LF standard frequency and time signal is transmitted at 40 kHz and 60 kHz. The time code is the same at both frequencies.

The receiver circuit 12 serving as the time data receiver includes an amplifier circuit that amplifies the LF standard frequency and time signal received by the antenna 11; a band-pass filter that extracts only desired frequency components from the amplified LF standard frequency and time signal; a modulation circuit that smoothens and modulates the LF standard frequency; an AGC (Automatic Gain Control) circuit that performs gain control of the amplifier circuit so that the reception level of the LF standard frequency and time signal is constant; a decoder circuit that decodes and outputs the modulated LF standard frequency and time signal; and the like.

The band-pass filter may include, for example, a filter that extracts a frequency of 40 kHz and a filter that extracts a frequency of 60 kHz, which are arranged in parallel to each other.

Of the 40-kHz and 60-kHz LF standard frequency and time signals, the receiver circuit 12 automatically receives the one that has better conditions. Normally the receiver circuit 12 stores the frequency of the previously received signal and performs reception at that frequency.

The oscillator circuit 14 oscillates a reference oscillation source, such as a crystal vibrator, at a high frequency, and the divider circuit 15 divides an oscillation signal thereof and outputs a predetermined reference signal (for example, a 4 Hz signal). The time counter 16 counts this reference signal and keeps the current time. Accordingly, the oscillator circuit 14 and the divider circuit 15 are included in a reference signal generating circuit of the present invention, and the time counter 16 is included in a timekeeping circuit.

Time information on the time kept by the time counter 16 is displayed via the display circuit 20 on the time display unit 21 including a liquid crystal display or the like. In this embodiment, the time information is displayed in a digital format on the time display unit 21.

When the receiver circuit 12 receives a standard frequency and time signal, the control circuit 13 determines whether time information received by the receiver circuit 12 is accurate. When it is determined that the time information is accurate, the control circuit 13 corrects, on the basis of this time information, time information of the time counter 16. Whether or not the received time information is accurate is determined by, for example, in the case of an LF standard frequency and time signal, receiving a plurality of frames (normally two to three frames) of time information transmitted at intervals of one minute and determining whether or not pieces of the received time information have a predetermined time difference. For example, when continuous pieces of time information are received, it is determined whether the pieces of time information are at intervals of one minute.

The time signal generating circuit 17 generates a time signal in a predetermined format on the basis of current time data transmitted from the time counter 16. The transmitter circuit 18 superimposes this time signal on a carrier at a predetermined frequency and transmits this carrier with the time signal to the outside via the coil 19.

Figure 5:
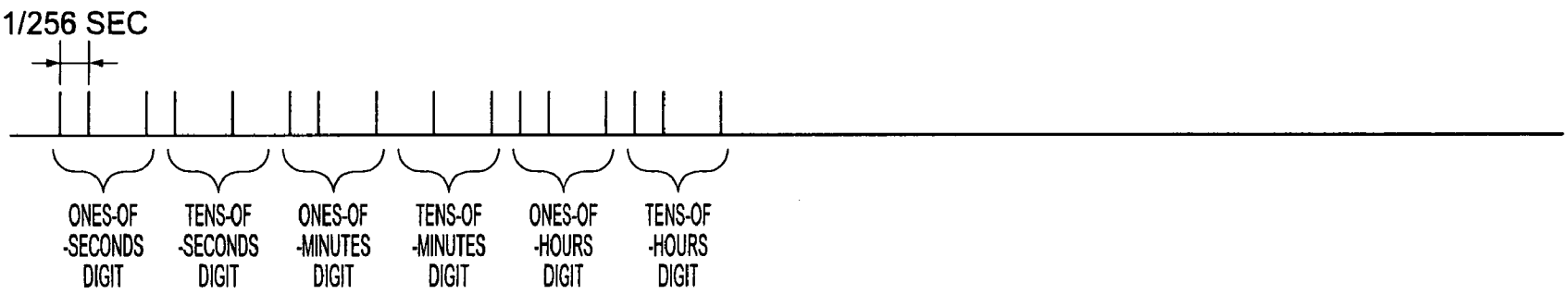
FIG. 5 is a diagram showing the format of a time signal of the first embodiment.

The time signal generated by the time signal generating circuit 17 indicates, for example, as shown in FIG. 5, hours, minutes, and seconds. The number in each digit of the hours, minutes, and seconds is represented by a digital signal of 2 to 4 bits.

The transmitter circuit 18 transmits this time signal on a carrier at a predetermined frequency. In this embodiment, the time signal is transmitted on data at 256 Hz (intervals of $1/256$ sec) from the coil 19 with a cycle of $1/2$ sec. In other words, two time signals are transmitted every second.

Even when each digit is represented by a 4-bit digital signal, one time signal is transmitted in 4 bits×6 digits/256=approximately 0.094 sec. When two time signals are transmitted every second, a no-signal period of approximately 0.4 sec is provided between the time signals.

The time signal generating circuit 17 and the transmitter circuit 18 are also controlled by the control circuit 13.

The master timepiece 2 is installed in a building at a position such as a position near a window, at which a standard frequency and time signal is easily received.

The master station may not include the display circuit 20 and the time display unit 21 and may only include a function of relaying time information (a function of receiving a standard frequency and time signal and a function of generating and transmitting a time signal).

As shown in FIG. 3, the slave timepiece 3 includes an oscillator circuit 31, a divider circuit 32, a time counter 33, a motor driving circuit 34, a motor driving coil 35, a time display unit 36, a receiver circuit 37, a control circuit 38, and a hand position counter 39.

The oscillator circuit 31, the divider circuit 32, and the time counter 33 are the same as the oscillator circuit 14, the divider circuit 15, and the time counter 16, respectively, of the master timepiece 2.

The time counter 33 outputs a predetermined signal to the motor driving circuit 34 every time the counter value is incremented and the second digit is carried over (the ones-of-seconds digit is changed) in response to an input of a predetermined (e.g., 4 Hz) reference signal from the divider circuit 32.

Figure 6:
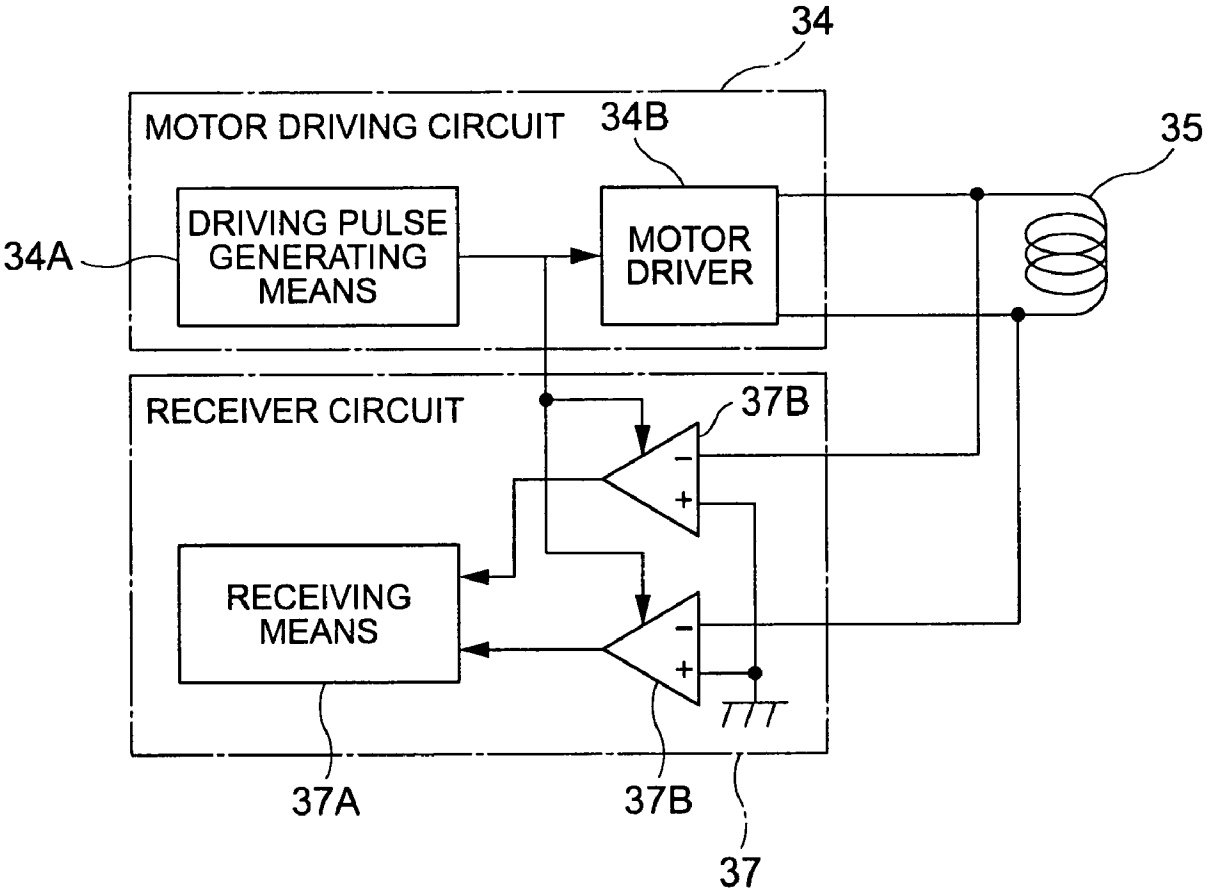
FIG. 6 is a circuit block diagram showing the configuration of a motor driving circuit and a receiver circuit of the first embodiment.

As shown in FIG. 6, the motor driving circuit 34 includes a drive pulse generating means 34A that generates a drive pulse using a signal from the divider circuit 32 or the like and a motor driver 34B that applies the drive pulse to the coil 35. The motor driving circuit 34 outputs a motor drive pulse to the motor driving coil 35 that drives hands 36A of the time display unit 36 and, every time the time on the time counter 33 changes by one second, moves the second hand of the hands 36A by one second in a stepwise manner.

The motor drive pulse is also output to the hand position counter 39. Every time the hand(s) is moved in response to the drive pulse, the counter value of the hand position counter 39 also changes. The value of the hand position counter 39 is associated with the positions of the hands 36A.

The receiver circuit 37 includes a receiving means 37A and two comparators 37B. The comparators 37B are stopped while the drive pulse is output from the drive pulse generating means 34A and are activated while the drive pulse is not output from the drive pulse generating means 34A. The motor driving coil 35 is connected to the comparators 37B. The comparators 37B each separate a time signal from a signal received by the coil 35 and output the separated time signal to the receiving means 37A.

The receiving means 37A converts the signals transmitted from the comparator 37B into predetermined time data.

The control circuit 38 compares the time data received by the receiver circuit 37, that is, the corrected counter value of the time counter 33, with the counter value of the hand position counter 39 and controls the motor driving circuit 34 to fast-forward the hands 36A by the difference between the two counter values (may inversely rotate the hands 36A when the motor can be inversely rotated). With the above-described processing, the positions of the hands 36A, that is, the value of the hand position counter 39, agree with the value of the time counter 33, that is, the received time data, and hand adjustment is thus completed.

The operation of the first embodiment arranged as described above will now be described using flowcharts of FIGS. 7 to 9 and a timing chart of FIG. 10.

On the basis of the flowchart of FIG. 7, a process by the master timepiece 2 will now be described.

The master timepiece 2 increments the count of the time counter 16 using a reference signal from the oscillator circuit 14 and the divider circuit 15 (step S1, hereinafter step is abbreviated as "S").

It is determined whether the time has reached 0 AM or 0 PM (12 o'clock) (S2). If the time has reached 0 AM or 0 PM, the control circuit 13 activates the receiver circuit 12 to receive a standard frequency and time signal (S3). If the standard frequency and time signal is received successfully, the control circuit 13 corrects the count of the time counter 16 on the basis of received time data (S4).

After the count of the time counter 16 is corrected in S4 or when the determination in S2 is "N (No)", the control circuit 13 outputs the count of the time counter 16 (time data) to the display circuit 20 and displays the time on the time display unit 21 (S5).

Then, the control circuit 13 outputs the time data of the time counter 16 to the time signal generating circuit 17 and causes the time signal generating circuit 17 to generate a time signal such as that described above (S6).

The generated time signal is transmitted to the outside by the transmitter circuit 18 via the coil 19 (S7). In this embodiment, as shown in FIG. 10, time signal S1 is transmitted from the coil 19 of the master timepiece 2 except for the period of reception of the standard frequency and time signal. As described above, two time signals are transmitted every second.

The master timepiece 2 repeats the processing in S1 to 7.

A process by the slave timepiece 3 will now be described with reference to the flowcharts of FIGS. 8 and 9.

The control circuit 38 of the slave timepiece 3 activates the receiver circuit 37 to perform reception of the time signal (S11). The control circuit 38 determines whether or not reception of the time signal is possible (S12).

In this embodiment, the slave timepiece 3 must be placed near the master timepiece 2 in order that the motor driving coil 35 of the slave timepiece 3 can receive the time signal. To this end, the stand clock 2B has a platform 2C on which the slave timepiece 3 is placed. When the slave timepiece 3 is placed on the platform 2C, the slave timepiece 3 can receive the time signal.

When the slave timepiece 3 is placed near the master timepiece 2, the slave timepiece 3 starts receiving the time signal using the driving coil 35. In this embodiment, as shown in FIG. 10, two time signals S1 are transmitted every second, and the interval T2 between the signals is set to be greater than the pulse width T1 of a motor drive pulse P1. In one second, at least one of the time signals S1 does not overlap the motor drive pulse P1. Therefore, the slave timepiece 3 receives at least one time signal S1 every second.

When reception is possible, that is, when the time signal is received successfully, the control circuit 38 performs the following time correction processing. Specifically, the control circuit 38 changes a reception flag indicating that the time signal is received to "1" (S13). Then, the control circuit 38 corrects data of the time counter 33 on the basis of the received time signal (standard time) (S14).

The control circuit 38 compares the value of the hand position counter 39 indicating the positions of the hands 36A with the updated value of the time counter 33, which has been updated on the basis of the time signal, and determines whether or not the value Ta of the hand position counter 39 is ahead of the value Tb of the time counter 33 by a period less than or equal to one minute (S15). In other words, it is determined whether $Tb<Ta\leqq Tb+1$ minute.

When the determination in S15 is "Y (Yes)", the control circuit 38 stops an output of the drive pulse from the motor driving circuit 34 and stops the movement of the hands (S16). The control circuit 38 increments the time counter using a reference signal (e.g., 4 Hz signal) from the divider circuit 32, that is, increments the counter value Tb of the time counter 33 (S17). Since the value Ta of the hand position counter 39 does not change because the movement of the hands is stopped, the difference between Ta and Tb gradually becomes smaller.

The control circuit 38 repeats the processing in S15 to S17 until it is determined that Ta=Tb in S15. Since Ta is ahead of Tb by a period less than or equal to one minute, the processing is completed within one minute. In this embodiment, the processing in S15 to S17 is provided since the hands 36A cannot be inversely rotated in this embodiment. The hands 36A can be corrected only by being fast-forwarded. In other words, when the time on the hand position counter 39 is, for example, one minute ahead of the time on the time counter 33, the hands 36A must be fast forwarded 23 hours and 59 minutes. Such fast forwarding requires time. Instead of fast forwarding the hands 36A, the movement of the hands is stopped, and the value of the time counter 33 is made equal to the value of the hand position counter 39 by making the time counter 33 catch up with the hand position counter 39.

It is determined whether the difference between the two counter values is less than or equal to one minute because a quartz timepiece, such as the slave timepiece 3, has an indication error of approximately 20 sec per month. In many cases, such an indication error is less than or equal to one minute.

When the determination in S15 is "N (No)", the control circuit 38 determines whether or not the value of the hand position counter 39 agrees with the value of the time counter 33 (S18).

Figure 9:
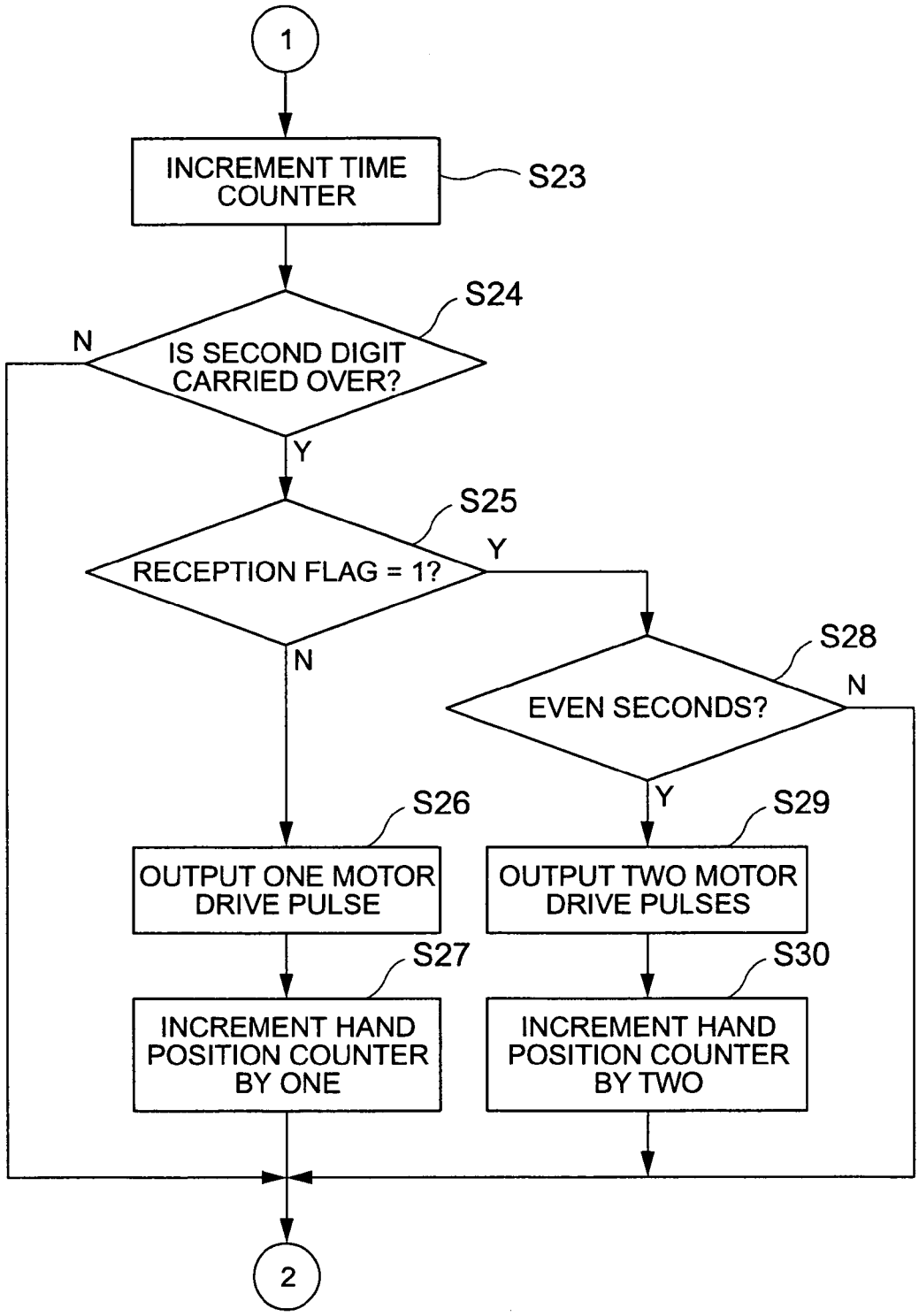
FIG. 9 is a flowchart continued from the operation of the slave timepiece of the first embodiment.

In a case in which the processing in S16 and S17 is performed or the like, when the counter values agree with each other, the process proceeds to a hand movement control process in FIG. 9 (S19).

When the counter values do not agree with each other, the control circuit 38 controls the motor driving circuit 34 to output one motor drive pulse to move the hands 36A by one step, which is usually one second (S20). Since the motor drive pulse is output, the counter value Ta of the hand position counter 39 is incremented by one (S21).

Since the control circuit 38 repeats the processing in S19 and S20 until the counter values agree with each other in S18, the hands are fast forwarded.

Figure 10:
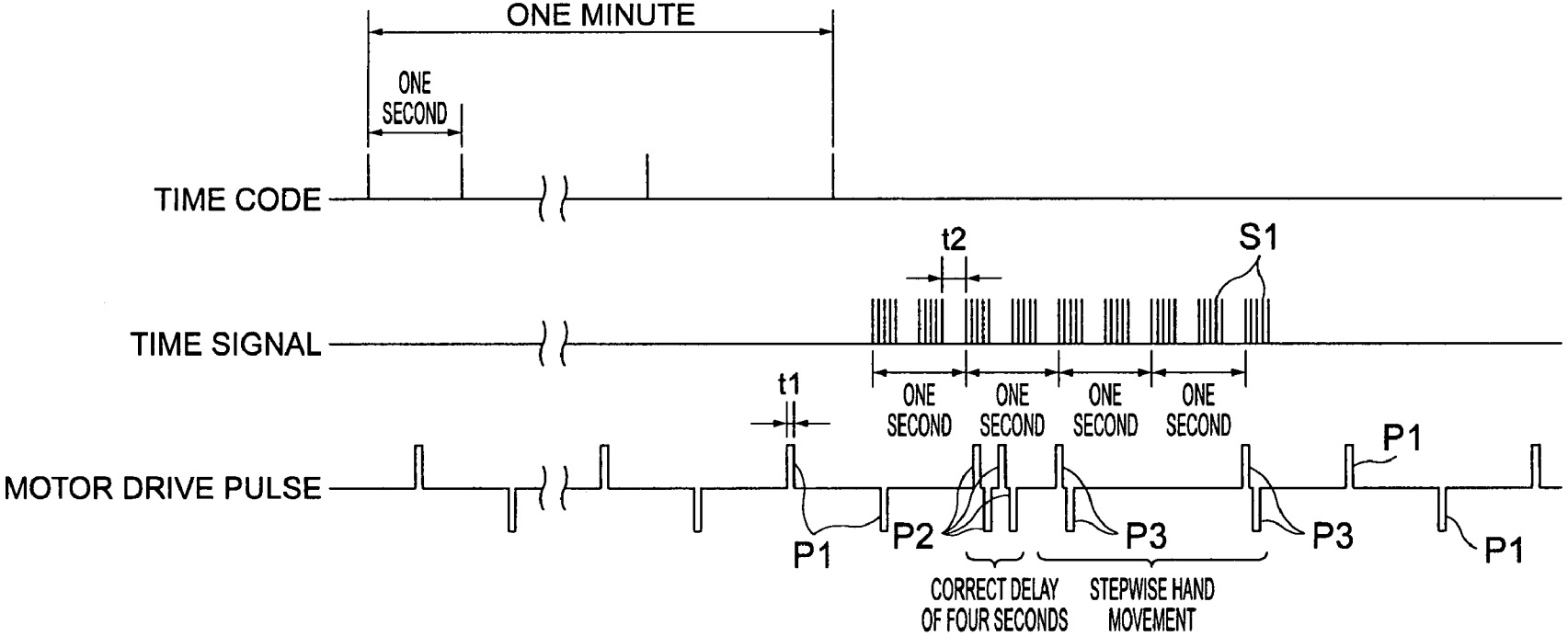
FIG. 10 is a timing chart showing a time signal and a motor drive pulse received by the slave timepiece of the first embodiment.

For example, in the example shown in FIG. 10, the hands 36A are behind by four seconds. After the time signal is received, four motor drive pulses (fast-forwarding pulses) P2 are output to correct this delay of four seconds.

In contrast, when the determination in S12 is "N", the reception flag is set to 0 (S22). As in a case in which the determination in S18 is "Y", the process proceeds to the hand movement control process in FIG. 9 (S19).

In the hand movement control process, as shown in FIG. 9, the control circuit 38 increments the time counter (S23). In other words, the counter value of the time counter 33 is sequentially incremented in response to the reference signal (e.g., 4 Hz) from the divider circuit 32.

The control circuit 38 determines whether or not the counter value indicates that the second digit is carried over, that is, the ones-of-seconds digit is carried over (S24). If the second digit is carried over, it is determined whether the reception flag is 1 (S25).

When the reception flag is not 1 ("N" in S25), one motor drive pulse is output (S26), and the hand position counter is incremented by one (S27). The control circuit 38 performs normal hand movement control.

In contrast, when the determination in S25 is "Y", that is, when the time signal is received, the control circuit 38 determines whether or not the value of the time counter 33 indicates even seconds (S28). When the counter value indicates even seconds, two motor drive pulses are output (S29), and the hand position counter is incremented by two (S30). In other words, as shown in FIG. 10, two-step-hand-movement control pulse P3 (the second hand of the hands is moved every two seconds) is output, and special hand movement control differing from normal control is performed.

When it is determined in S28 that the counter value indicates odd seconds, no motor drive pulse is output, and the hand position counter value remains unchanged. With the processing in S29 and S30, the positions of the hands and the hand position counter 39 are advanced by one second from the time counter 33. Since the positions of the hands 36A and the hand position counter 39 do not change at the subsequent odd seconds, an error due to the fact that the value of the hand position counter 39 agrees with the value of the time counter 33 does not occur.

Figure 8:
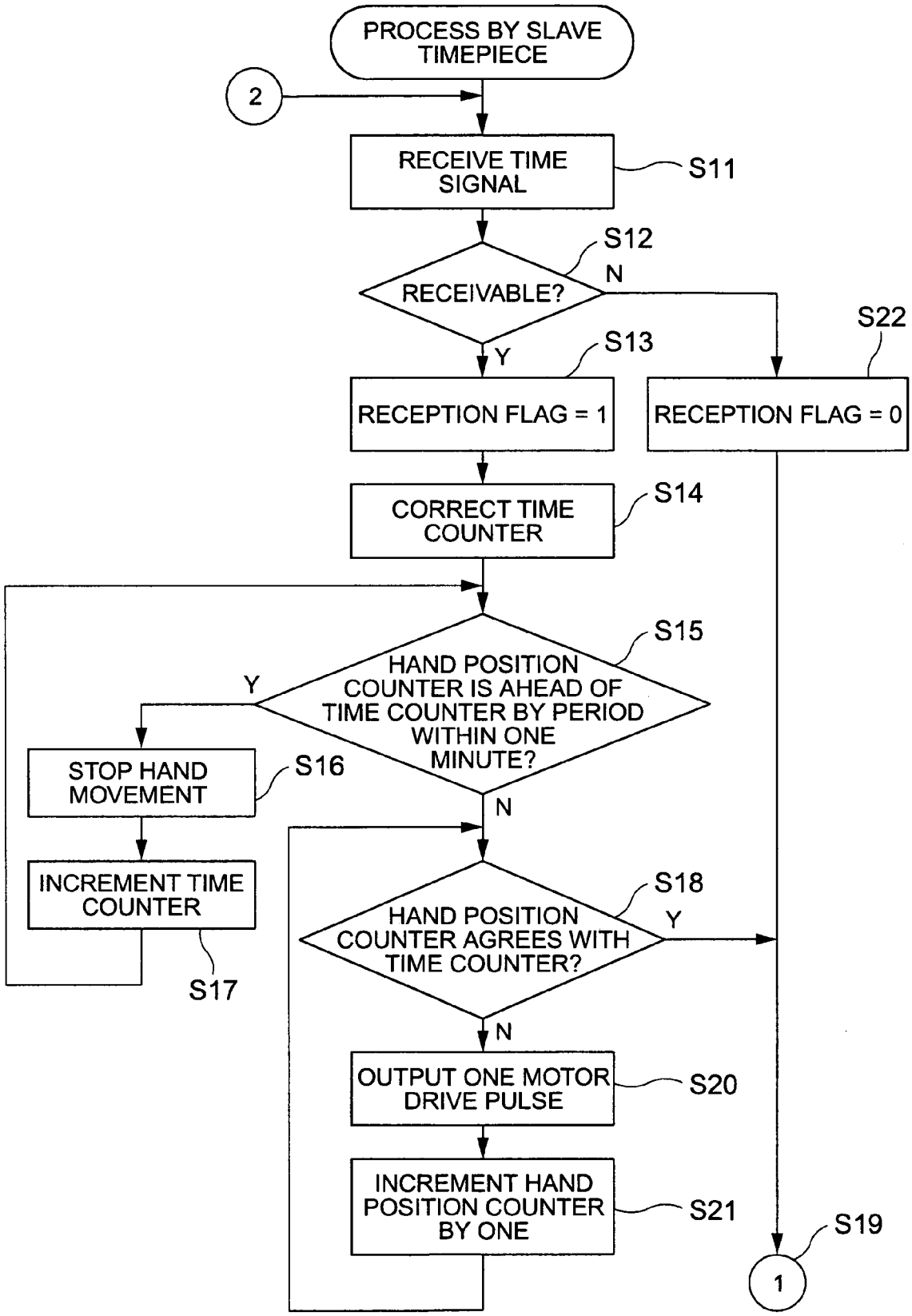
FIG. 8 is a flowchart showing the operation of the slave timepiece of the first embodiment.

When the determination in S24 or S28 is "N" or subsequent to the processing in S27 or S30, the process returns to the time signal reception processing (S11) in FIG. 8, and the previously-described processing flow is repeated.

The time signal in FIG. 10 represents a signal received by the slave timepiece 3. No time signal is received after the hands are moved by two steps. This is not because transmission from the master timepiece 2 is stopped, but because the slave timepiece 3 is separated from the master timepiece 2 and thus cannot receive the time signal. Therefore, the reception flag is set to "0", and the two-step hand movement is terminated. The process proceeds to normal hand movement control.

According to the first embodiment, the following advantages are achieved.

(1) Since the master timepiece 2 has the time signal generating circuit 17, the master timepiece 2 outputs a time signal differing from a received standard frequency and time signal, instead of outputting the same radio wave (signal) as the received standard frequency and time signal. Therefore, the master timepiece 2 can output a time signal that can be received by the motor driving coil 35 of the slave timepiece 3. The motor driving coil 35 of the slave timepiece 3 can thus be used as a receiving antenna.

The slave timepiece 3 need not be provided with an additional antenna. The number of components is reduced, and cost is reduced. Compared with a slave timepiece with a built-in antenna, the slave timepiece 3 can be miniaturized more easily. Reduction in size and thickness of the slave timepiece 3 is easily realized. Even a small timepiece, such as a wristwatch, can be used as the slave timepiece 3.

(2) The time signal output from the master timepiece 2 has a shorter cycle than that of the standard frequency and time signal. Therefore, the time signal can be transmitted and received within a short period of time. The time correction processing by the slave timepiece 3 can be performed within a short period of time. A user of the slave timepiece 3 is only required to place the slave timepiece 3 on the platform 2C of the master timepiece 2B for a few seconds to correct the time. User-friendliness is thus improved.

Compared with transmitting the standard frequency and time signal without changing it, the master timepiece 2 can transmit the time signal within a shorter period of time. Compared with a repeater or the like for relaying the standard frequency and time signal, the current consumption of the master timepiece 2 is reduced, resulting in energy savings. The possibility is reduced of the master timepiece 2 causing electromagnetic interference with another device, such as when the standard frequency and time signal is used.

The slave timepiece 3 can receive the time signal within a short period of time. The current consumption of the slave timepiece 3 is reduced, resulting in energy savings. Therefore, the duration of the slave timepiece 3 is extended compared with that of the timepieces 2 and 3 driven by a power supply, such as a primary battery or a secondary battery.

When the standard frequency and time signal is used, noise becomes influential, which may result in malfunction in which the time is not accurately corrected on the basis of erroneous detection. In this embodiment, the time signal is changed to a signal suitable for short-range transmission and then transmitted. The influence of noise is reduced, and malfunction is prevented.

(3) Since the time signal is output from the master timepiece 2, the output level of the time signal is increased compared with that of the LF standard frequency and time signal. The reception sensitivity of the slave timepiece 3 receiving the time signal need not be very high. Therefore, cost is reduced, and energy is saved.

Since the output level of the time signal is high, the possibility of the slave timepiece 3 being successful in receiving the time signal is very high. It is very likely that a radio-controlled timepiece that receives a very weak signal, such as a standard frequency and time signal, cannot receive radio waves when housed in a timepiece casing made of metal since this timepiece casing functions as a shield against radio waves. To solve this problem, a casing made of plastic must be used. In contrast, in this embodiment, since the master timepiece 2 outputs the time signal, the level of this time signal can be increased, and hence the slave timepiece 3 can be housed in a metal casing. Accordingly, there is no restriction on materials of the casing of the slave timepiece 3, and the design aspect can be improved.

(4) In the slave timepiece 3, the configuration of the receiver circuit 37 for receiving the time signal only needs the comparators 37B to separate the time signal and is not required to have a high-frequency synchronization circuit or the like, which is required by a receiver circuit for receiving a standard frequency and time signal. Accordingly, the circuit configuration is simplified, and cost is reduced.

(5) In reception of the time signal using the motor driving coil 35 of the slave timepiece 3, the coil 35 cannot receive the time signal while the motor drive pulse is being output. In this embodiment, the master timepiece 2 transmits two time signals every second, and the interval T2 between the signals is greater than the pulse width T1 of the motor drive pulse. In most cases, at least one of the time signals does not overlap the motor drive pulse even when the motor drive pulse is being output. Therefore, the slave timepiece 3 reliably receives the time signal even when the time signal transmission timing of the master timepiece 2 is not synchronized with the time signal reception timing of the slave timepiece 3, and hence a synchronization circuit or the like becomes unnecessary. The circuit configuration is simplified, and cost is reduced.

(6) When a general analog quartz timepiece serves as the slave timepiece 3, this analog quartz timepiece needs to be equipped with only the receiver circuit 37 and the control circuit 38; In particular, these circuits 37 and 38 can be included along with other circuits in an IC. Compared with a normal timepiece, there is no increase in the number of components. Therefore, reduction in size, thickness, and cost can be achieved.

(7) Upon reception of the time signal from the master timepiece 2, the slave timepiece 3 performs two-step hand movement by continuously outputting motor drive pulses and continuously moving the second hand by two seconds. The user thus easily determines whether or not the slave timepiece 3 has successfully received the time information. Since whether or not the reception is successful is displayed by moving the hands in a special manner, an additional liquid crystal display, lamp, or the like for displaying that the reception is successful is not necessary. Accordingly, an increase in the number of components is suppressed, and cost is thus reduced.

[Second Embodiment]

A time measurement system according to a second embodiment of the present invention will now be described on the basis of FIGS. 11 to 16. In embodiments described below, the same reference numeral is given to the same or a similar element corresponding to that in the previous embodiment, and a description thereof is omitted.

This embodiment differs from the first embodiment in that (A) both the master timepiece 2 and the slave timepiece 3 have switches (input means) for controlling transmission and reception of the time signal; and (B) since the slave timepiece 3 has a transmitter circuit and the master timepiece 2 has a receiver circuit, the master timepiece 2 can determine that the slave timepiece 3 has successfully received the time signal.

Figure 11:
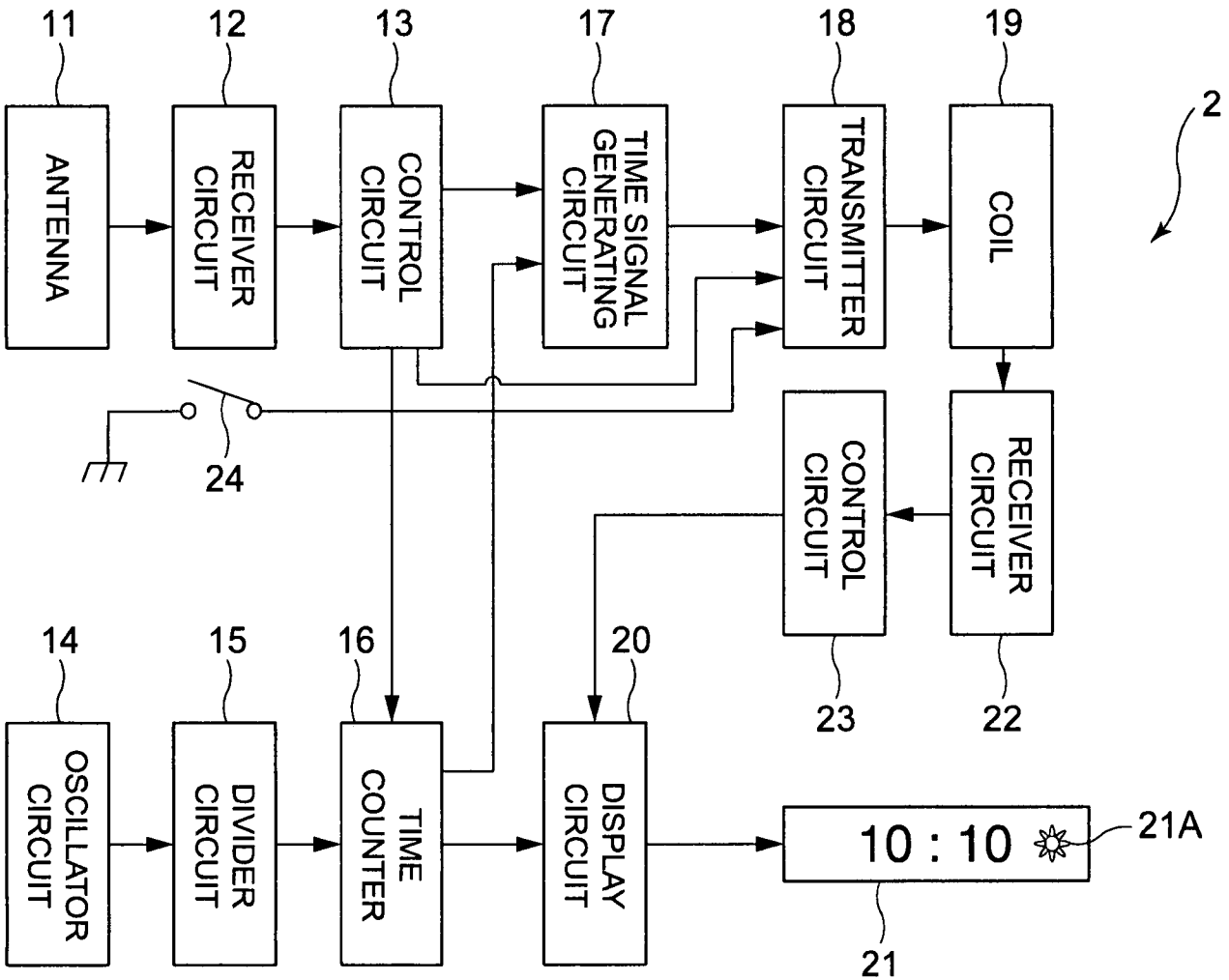
FIG. 11 is a block diagram showing the configuration of a master timepiece according to a second embodiment of the present invention.

As shown in FIG. 11, the master timepiece 2 includes, as in the first embodiment, the antenna 11, the receiver circuit 12 serving as the time data receiver, the control circuit 13, the oscillator circuit 14, the divider circuit 15, the time counter 16, the time signal generating circuit 17, the transmitter circuit 18, the coil 19, the display circuit 20, and the time display unit 21. In addition, the master timepiece 2 includes a receiver circuit 22, a control circuit 23, and a switch 24 serving as input means.

The receiver circuit 22 is connected to the coil 19. Using the coil 19 as an antenna, the receiver circuit 22 receives a signal transmitted from the slave timepiece 3. When the receiver circuit 22 receives a receipt acknowledgement signal output from the slave timepiece 3, the control circuit 23 causes a predetermined symbol (mark) 21A to flash up on the time display unit 21 via the display circuit 20.

The switch 24 is connected to the transmitter circuit 18. The control circuit 13 controls the transmitter circuit 18 to transmit the time signal only when the switch 24 is turned ON (connected). The switch 24 may be operated by the user by pressing a switch button on the master timepiece 2. Alternatively, the switch 24 may be automatically turned ON upon detection that the slave timepiece 3 is placed on the platform 2C of the master timepiece 2 by a sensor or the like on the platform 2C. Such a detection sensor for detecting that the slave timepiece 3 is placed may be a weight sensor, an optical sensor, a contact sensor, or the like for detecting the placement state of the slave timepiece 3.

Figure 12:
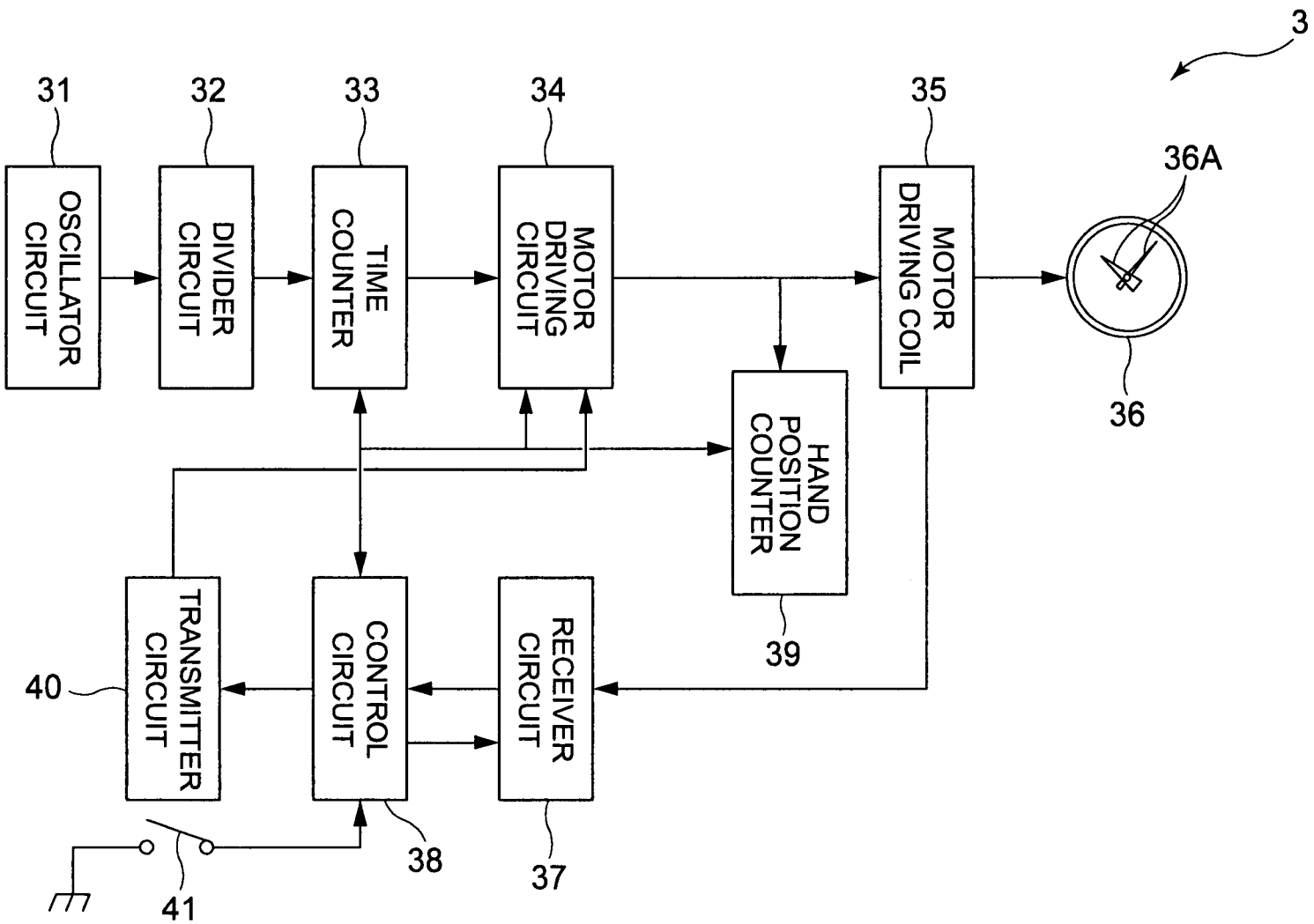
FIG. 12 is a block diagram showing the configuration of a slave timepiece of the second embodiment.

As shown in FIG. 12, the slave timepiece 3 includes, as in the first embodiment, the oscillator circuit 31, the divider circuit 32, the time counter 33, the motor driving circuit 34, the motor driving coil 35, the time display unit 36, the receiver circuit 37, the control circuit 38, and the hand position counter 39. In addition, the slave timepiece 3 includes a transmitter circuit 40 and a switch 41.

The transmitter circuit 40 is controlled by the control circuit 38 to transmit a receipt acknowledgement signal via the motor driving circuit 34 and the motor driving coil 35. Specifically, when the receiver circuit 37 is successful in receiving the time signal, the control circuit 38 activates the transmitter circuit 40 to transmit a receipt acknowledgement signal indicating that the reception is successful to the master timepiece 2.

The switch 41 is connected to the control circuit 38. The control circuit 38 activates the receiver circuit 37 to receive the time signal only when the switch 41 is turned ON.

Figure 13:
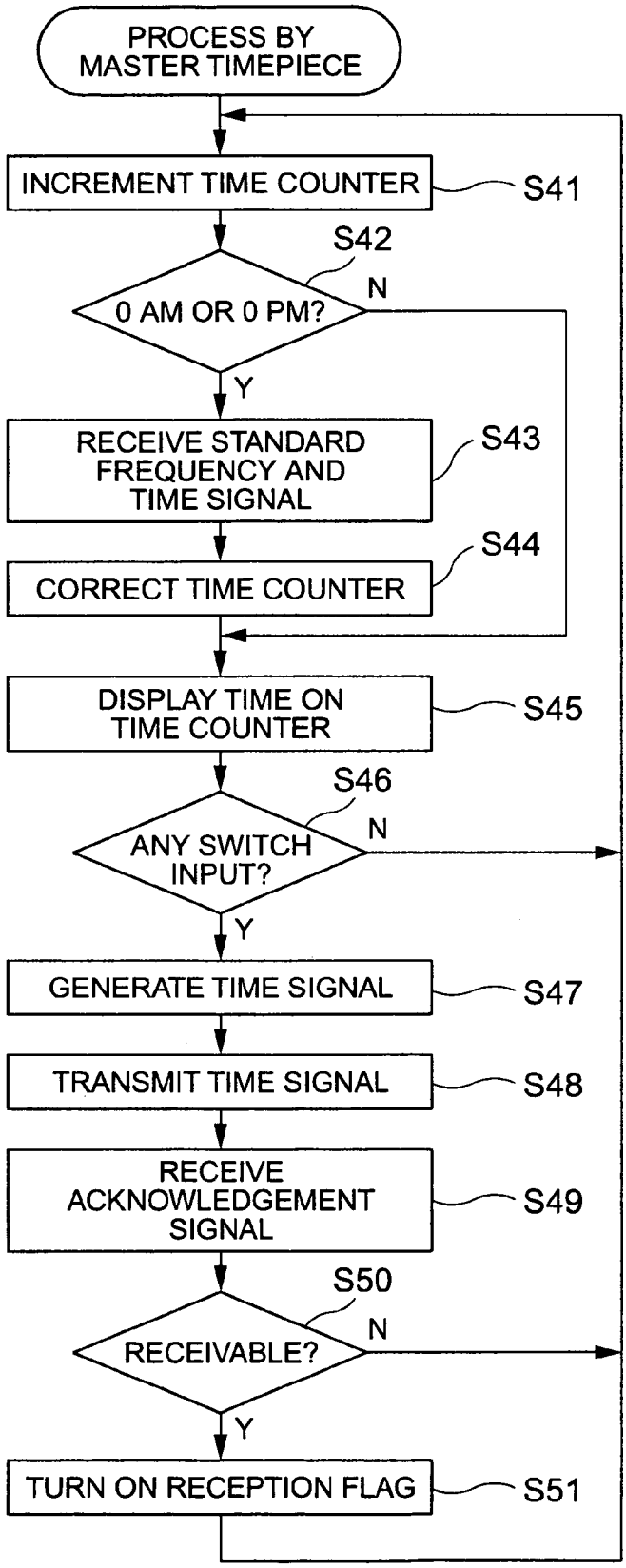
FIG. 13 is a flowchart showing the operation of the master timepiece of the second embodiment.

The operation of the second embodiment arranged as described above will now be described using flowcharts of FIGS. 13 to 15 and a timing chart of FIG. 16.

As in the first embodiment, the master timepiece 2 increments the count of the time counter 16 (S41). It is determined whether the time has reached 0 AM or 0 PM (12 o'clock) (S42). If the time has reached 0 AM or 0 PM, the control circuit 13 activates the receiver circuit 12 to receive a standard frequency and time signal (S43). If the standard frequency and time signal is received successfully, the control circuit 13 corrects the count of the time counter 16 on the basis of received time data (S44).

After the count of the time counter 16 is corrected in S44 or when the determination in S42 is "N", the control circuit 13 displays the count of the time counter 16 on the time display unit 21 via the display circuit 20 (S45).

It is determined whether or not there is an input from the switch 24 (S46). If there is a switch input, the time signal generating circuit 17 generates a time signal (S47) and transmits the time signal via the transmitter circuit 18 and the coil 19 (S48).

Figure 16:
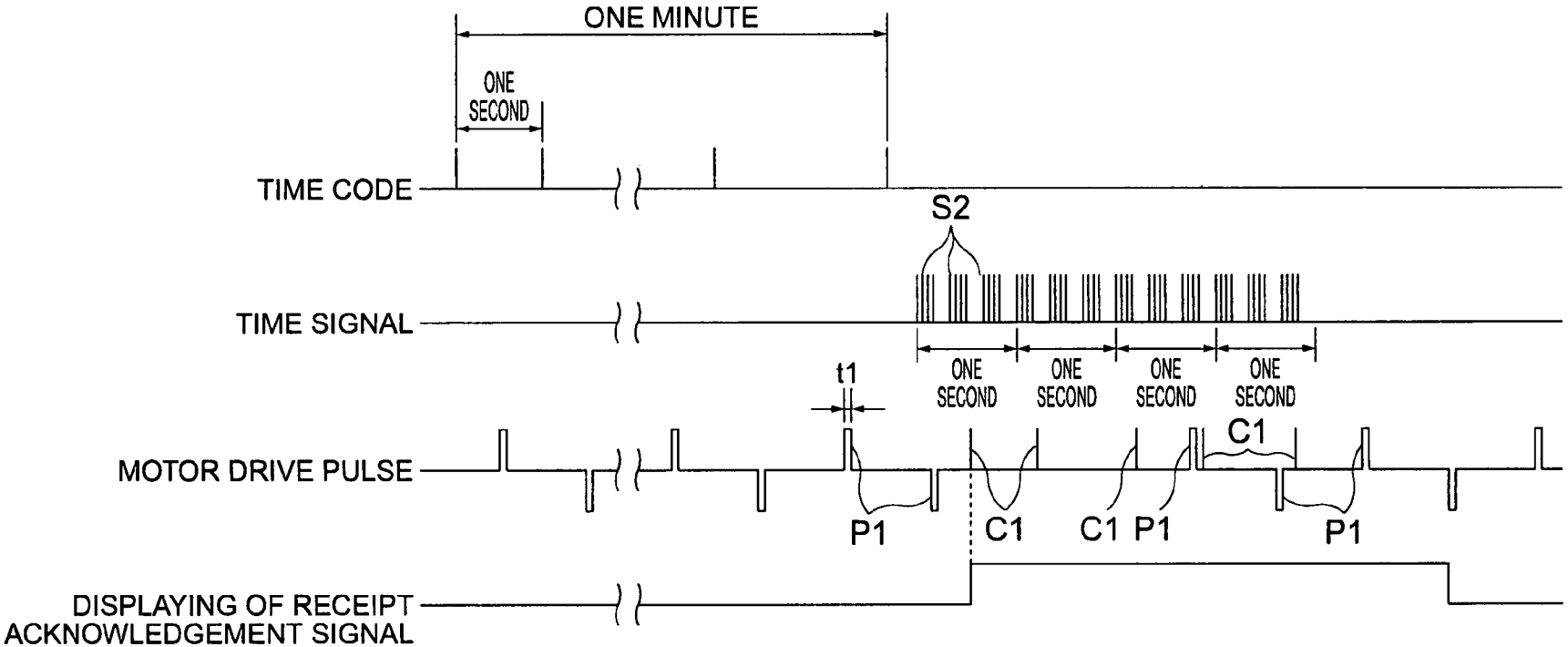
FIG. 16 is a timing chart showing a time signal and a motor drive pulse received by the slave timepiece of the second embodiment.

In this embodiment, as shown in FIG. 16, three time signals S2 are transmitted every second.

The control circuit 23 of the master timepiece 2 drives the receiver circuit 22 to perform reception of the receipt acknowledgement signal from the slave timepiece 3 (S49). In other words, when reception of the acknowledgement signal is possible (S50), the reception flag, that is, the mark 21A, is turned on (S51).

In contrast, when the determination in S46 or S50 is "N", the process returns to the time counter incrementing processing (S41). The master timepiece 2 repeats the processing in S41 to S51.

In contrast, a process by the slave timepiece 3 will now be described on the basis of the flowcharts of FIGS. 14 and 15.

The control circuit 38 of the slave timepiece 3 determines whether or not there is an input from the switch 41 (S61). If there is an input from the switch 41, the control circuit 38 activates the receiver circuit 37 to perform reception of the time signal (S62). The control circuit 38 determines whether or not reception is possible (S63).

In this embodiment, the switch 41 of the slave timepiece 3 is turned ON by pulling a crown of the slave timepiece 3 to the first stage and turned OFF by moving the crown to other stages. When the slave timepiece 3 is placed on the platform 2C while the crown of the slave timepiece 3 is pulled to the first stage, the time signal is transmitted/received.

In this embodiment, as shown in FIG. 16, three time signals S2 are output every second. In one second, at least one time signal S2 does not overlap the motor drive pulse P1. Therefore, the slave timepiece 3 can receive at least one time signal every second.

When reception is possible, the control circuit 38 controls the motor driving circuit 34 to transmit a receipt acknowledgement signal via the motor driving coil 35 (S64). This acknowledgement signal is, as shown in FIG. 16, signal Cl with a small pulse width, compared with that of the motor drive pulse P1, so that the motor is not driven.

Subsequently, the control circuit 38 performs the time correction processing similar to that of the first embodiment. In other words, the control circuit 38 corrects data of the time counter 33 on the basis of the received time signal (standard time) (S65).

The control circuit 38 compares the value of the hand position counter 39 with the value of the time counter 33 and determines whether or not the value of the hand position counter 39 is ahead of the value of the time counter by a period less than or equal to one minute (S66). In other words, when one counter value is ahead of the other counter value by a period less than or equal to one minute, as in the first embodiment, the movement of the hands is stopped (S67), and the time counter is incremented (S68).

For example, as in the example shown in FIG. 16, after having received the time signal, the slave timepiece 3 outputs no motor drive pulse for almost two seconds. As a result, the movement of the hands is stopped.

When the determination in S66 is "N", the control circuit 38 determines whether the values of the counters 33 and 39 agree with each other (S69). When the values do not agree with each other, as in the first embodiment, one motor drive pulse is output (S70), and the count of the hand position counter 39 is incremented (S71).

Figure 15:
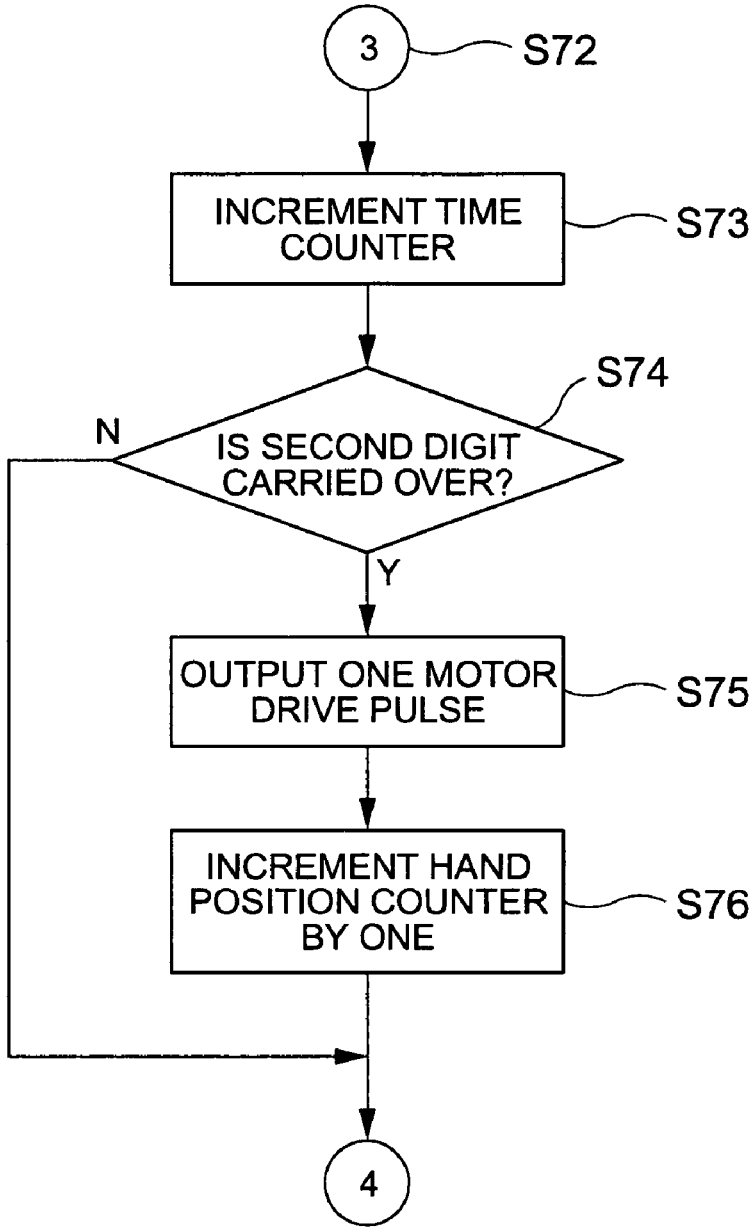
FIG. 15 is a flowchart continued from the operation of the slave timepiece of the second embodiment.

In contrast, when the determination in S61 or S63 is "N" or when the determination in S69 is "Y", the process proceeds to a hand movement control process in FIG. 15 (S72).

In the hand movement control process, as shown in FIG. 15, as in the first embodiment, the time counter is incremented (S73), and it is determined whether or not the counter value indicates that the second digit is carried over (S74) by the control circuit 38.

When the second digit is carried over, one motor drive pulse is output (S74), and the hand position counter is incremented by one (S75). The control circuit 38 performs normal hand movement control.

Figure 14:
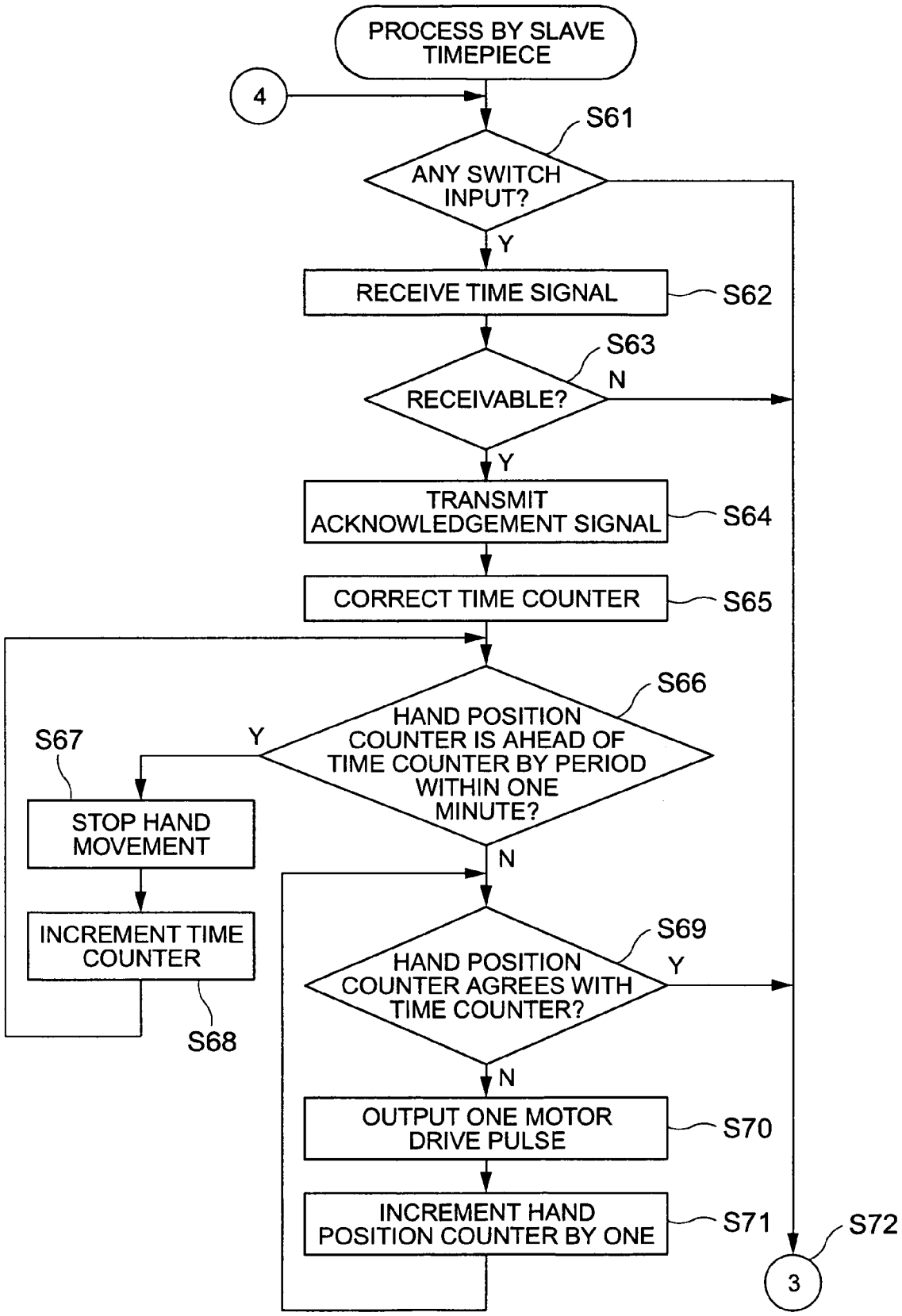
FIG. 14 is a flowchart showing the operation of the slave timepiece of the second embodiment.

After the processing in S76 or when the determination in S74 is "N", the process returns to the time signal reception processing (S61) in FIG. 14, and the previously-described processing flow is repeated.

In other words, in this embodiment, the slave timepiece 3 does not display that the time signal is received, and only the master timepiece 2 displays the receipt acknowledgement.

Displaying the receipt acknowledgement by the master timepiece 2 is, as shown in FIG. 16, stopped when the slave timepiece 3 stops outputting the receipt acknowledgement signal. Specifically, at least one receipt acknowledgement signal is output every second while the slave timepiece 3 is receiving the time signal. After one second or greater has elapsed since the reception of the last receipt acknowledgement signal, the displaying of the receipt acknowledgement is stopped.

According to the second embodiment, in addition to the advantages (1) to (6) of the first embodiment, the following advantages are achieved.

(8) The switches 24 and 41 are provided, and the time signal is transmitted/received only when the switches 24 and 41 are turned ON. The power consumption of the master timepiece 2 and the slave timepiece 3 is further reduced, resulting in energy savings. The duration of the master timepiece 2 and the slave timepiece 3 is also extended.

(9) Since the master timepiece 2 includes the receiver circuit 22 and the slave timepiece 3 includes the transmitter circuit 40, the reception of the time signal by the slave timepiece 3 is transmitted as an acknowledgement signal to the master timepiece 2 and is displayed (light is turned on) on the time display unit 21 of the master timepiece 2. With the master timepiece 2, the user easily determines that the time signal is received successfully. The time is thus adjusted in a simple and reliable manner.

(10) The switch 24 is automatically turned ON when the slave timepiece 3 is placed on the platform 2C including a built-in transmitting coil of the master timepiece 2 and automatically turned OFF when the slave timepiece 3 is removed from the platform 2C. The user thus needs not operate the switch 24, and user-friendliness is improved.

The switch 41 is turned ON by pulling the crown of the slave timepiece 3 to the first stage. The switch 41 is turned ON and OFF by simple operation. In addition, the master timepiece 2 and the slave timepiece 3 need not have additional buttons for operating the switches 24 and 41. Therefore, the cost and size of the clocks 2 and 3 can be reduced.

[Third Embodiment]

A time measurement system according to a third embodiment of the present invention will now be described on the basis of FIGS. 17 to 21.

This embodiment differs from the first embodiment in that (C) the master timepiece 2 has a receiver circuit that receives a motor drive pulse of the slave timepiece 3, and the time signal is transmitted after acknowledgement of the reception of the motor drive pulse. Since the configuration of the slave timepiece 3 is the same as that of the first embodiment, a description thereof is omitted.

Figure 17:
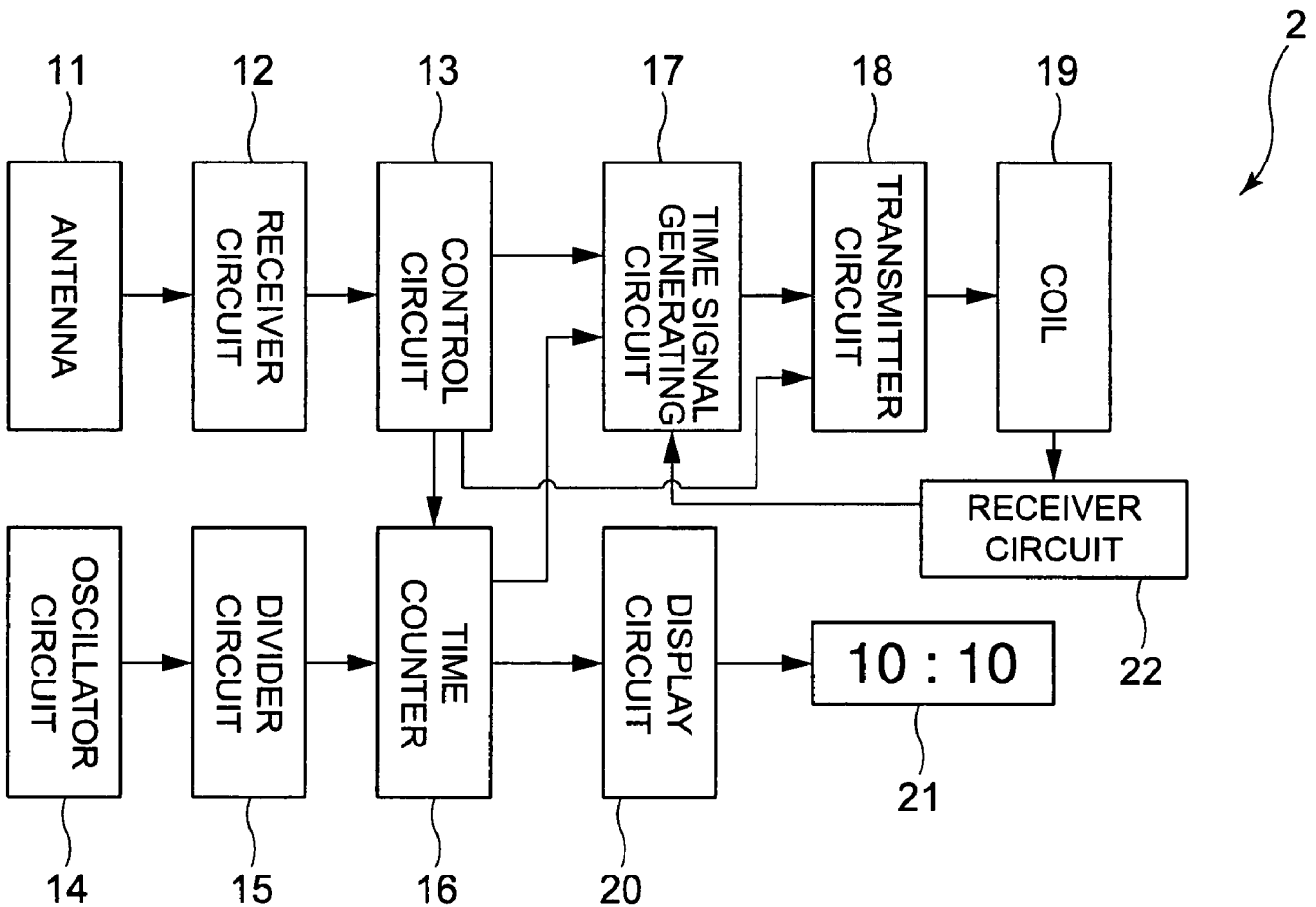
FIG. 17 is a block diagram showing the configuration of a master timepiece according to a third embodiment of the present invention.

Specifically, as shown in FIG. 17, the master timepiece 2 includes, as in the first embodiment, the antenna 11, the receiver circuit 12 serving as the time data receiver, the control circuit 13, the oscillator circuit 14, the divider circuit 15, the time counter 16, the time signal generating circuit 17, the transmitter circuit 18, the coil 19, the display circuit 20, and the time display unit 21. In addition, the master timepiece 2 includes the receiver circuit 22.

The receiver circuit 22 is, as in the second embodiment, connected to the coil 19. Upon emission of the motor drive pulse from the slave timepiece 3, a magnetic flux leaking therefrom is detected via the coil 19. When the receiver circuit 22 detects the motor drive pulse, the time signal generating circuit 17 outputs the time signal.

The operation of the third embodiment arranged as described above will now be described using flowcharts of FIGS. 18 to 20 and a timing chart of FIG. 21.

Figure 7:
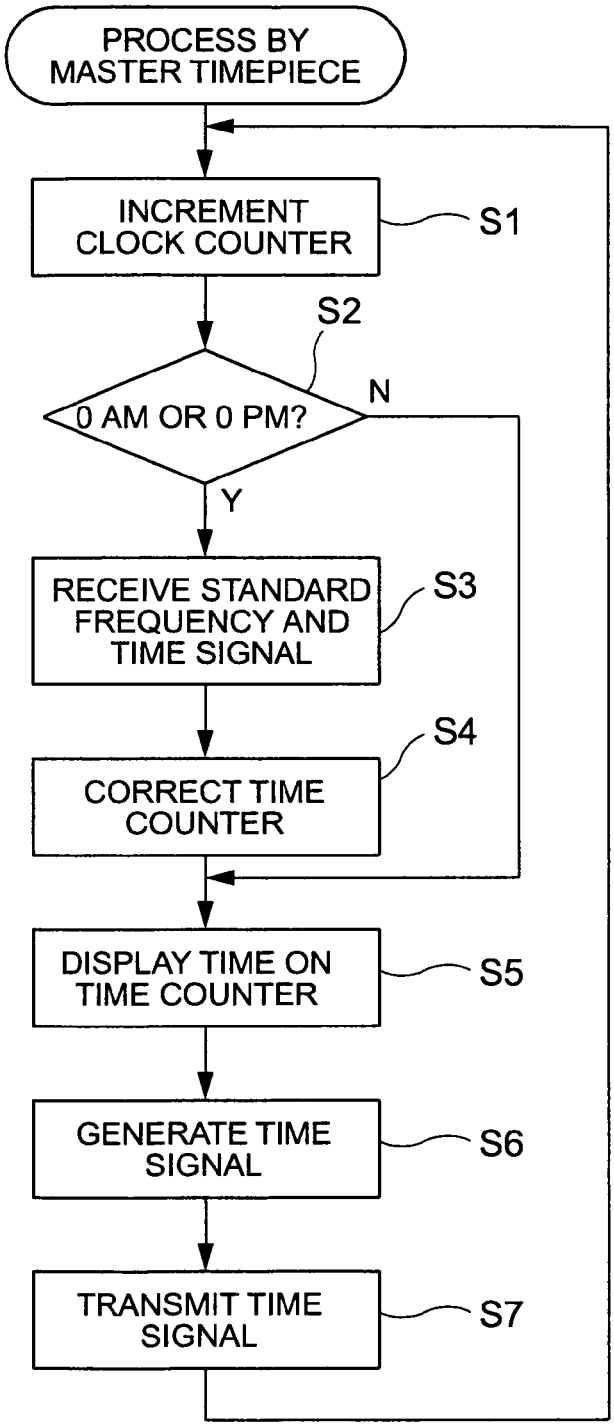
FIG. 7 is a flowchart showing the operation of the master timepiece of the first embodiment.
Figure 18:
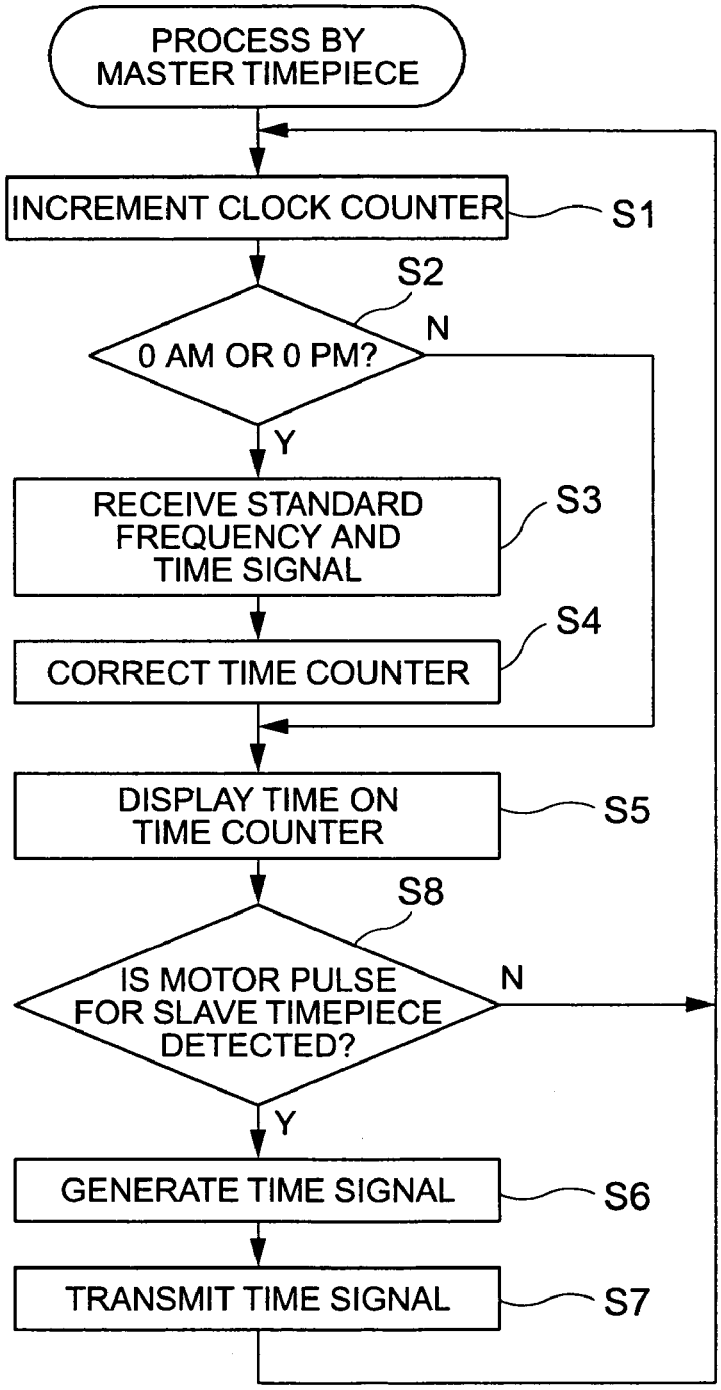
FIG. 18 is a flowchart showing the operation of the master timepiece of the third embodiment.

The flowchart in FIG. 18 showing a process by the master timepiece 2 is substantially the same as that of the first embodiment shown in FIG. 7. Therefore, the same reference numeral is given to the same processing, and a description thereof is omitted.

Specifically, this embodiment is different in that, after the time on the time counter is displayed (S5), it is determined whether or not the motor drive pulse of the slave timepiece 3 is detected (S8); only when the motor drive pulse is detected, the time signal is generated (S6) and transmitted (S7).

As described above, when the time signal is transmitted only when the motor drive pulse of the slave timepiece 3 is detected, the time signal does not overlap the motor drive pulse since there is an interval of approximately one second until the subsequent motor drive pulse is output, and hence the slave timepiece 3 can receive the time signal. For example, as shown in FIG. 21, time signal S3 is transmitted after the motor drive pulse P1 is output. Since time signal S3 is transmitted only when the motor drive pulse P1 is detected by the master timepiece 2, transmission of the time signal is stopped when the slave timepiece 3 is removed from the master timepiece 2 and hence the master timepiece 2 becomes unable to detect the motor drive pulse.

When no motor drive pulse is detected in S8, no time signal is transmitted, and the process returns to the time counter incrementing processing (S1). The master timepiece 2 repeats the processing in S1 to S8 in FIG. 18.

Figure 19:
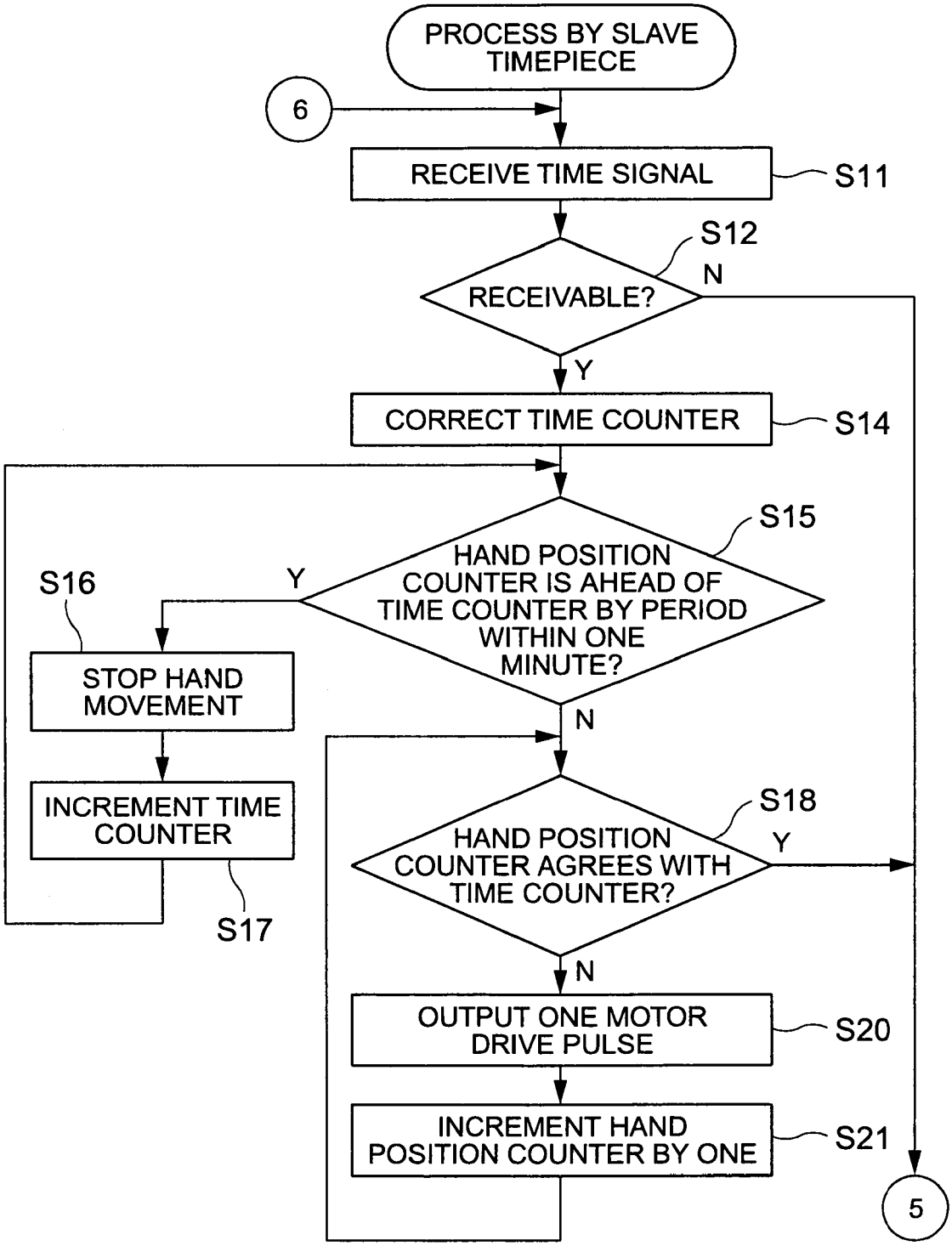
FIG. 19 is a flowchart showing the operation of a slave timepiece of the third embodiment.
Figure 20:
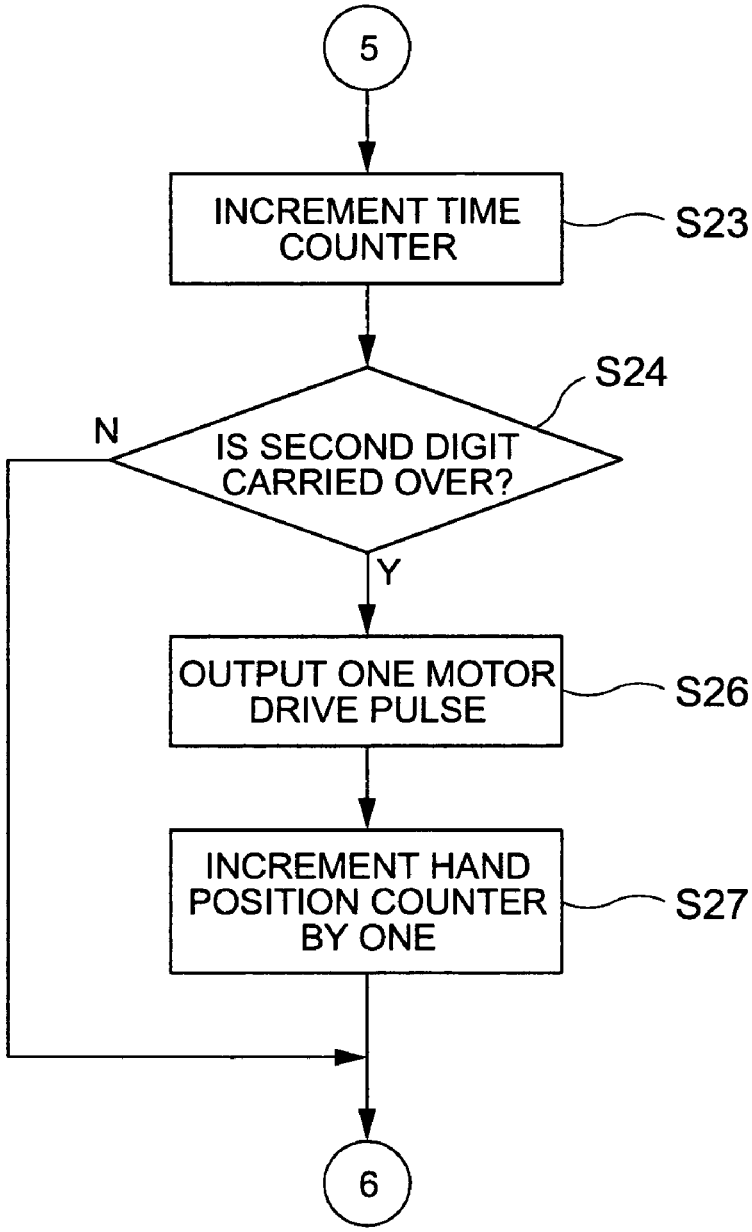
FIG. 20 is a flowchart continued from the operation of the slave timepiece of the third embodiment.
Figure 21:
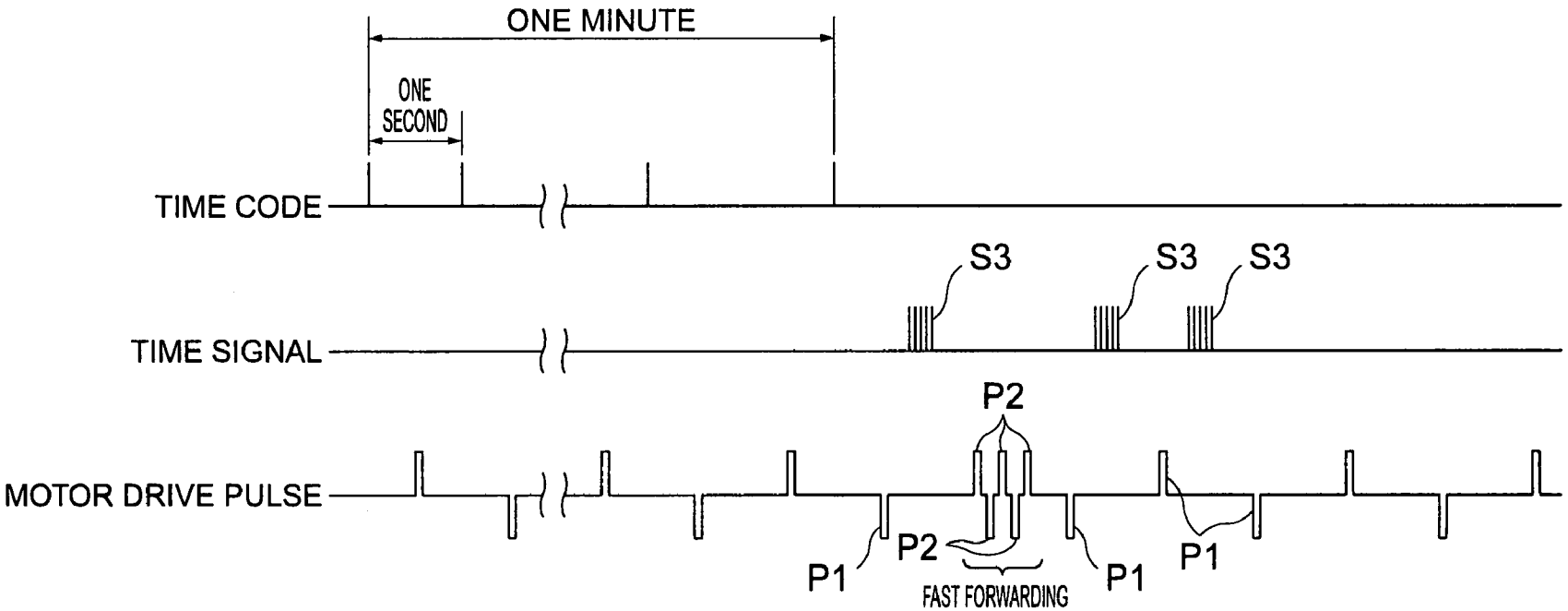
FIG. 21 is a timing chart showing a time signal and a motor drive pulse received by the slave timepiece of the third embodiment.

The flowcharts in FIGS. 19 and 20 showing a process by the slave timepiece 3 is substantially the same as that of the first embodiment shown in FIGS. 8 and 9. Therefore, the same reference numeral is given to the same processing, and a description thereof is omitted.

In this embodiment, since the slave timepiece 3 does not display that the time signal is received, this embodiment has no processing corresponding to the setting of the reception flag (S13 and S22) of the first embodiment. Accordingly, this embodiment has no processing corresponding to the two-step hand movement processing (S28 to S30) or the like. Other than these points, the processing in this embodiment is similar to that of the first embodiment.

Specifically, as shown in FIG. 19, the slave timepiece 3 performs reception of the time signal (S11) and then determines whether the time signal can be received (S12). When the time signal can be received, as in the first embodiment, the time counter is corrected (S14), and the hands 36A are corrected (S15 to S21).

When it is determined in S12 that the time signal is not received or when the values of the counters 33 and 39 agree with each other in S18, the process proceeds to a hand movement control process shown in FIG. 20.

In this hand movement process, as in the second embodiment, after the time counter is incremented (S23), normal hand movement processing is performed. That is, it is determined whether or not the second digit is carried over (S24); the motor drive pulse is output (S26); and the hand position counter is incremented (S27).

According to the third embodiment, in addition to the advantages of (1) to (6) of the above-described embodiments, the following advantages are achieved.

(11) Since the time signal is output after the motor drive pulse of the slave timepiece 3 is detected by the coil 19, the motor drive pulse P1 does not overlap the time signal S3. The slave timepiece 3 can reliably receive the time signal. In other words, the motor drive pulse is a pulse signal output with a one-second cycle, and the pulse width of the motor drive pulse is a few msec.

Therefore, upon detection of the motor drive pulse, there is a period of approximately 0.9 sec until the subsequent motor drive pulse is output. The signal width of the time signal is less than or equal to 0.1 sec. When the time signal is output after the detection of the motor drive pulse, transmission of the time signal is completed within the output interval of the motor drive pulse. The slave timepiece 3 can reliably receive the time signal.

Since a special synchronization circuit or the like is unnecessary, increases in the number of components and cost are suppressed.

(12) In order that the master timepiece 2 can detect the motor drive pulse of the slave timepiece 3, the motor driving coil 35 of the slave timepiece 3 must be placed near the coil 19 of the master timepiece 2. In other words, when the slave timepiece 3 is separated from the master timepiece 2, the receiver circuit 22 cannot detect the motor drive pulse. As a result, the transmission of the time signal is stopped. Therefore, the master timepiece 2 outputs the time signal only when necessary. Energy is thus saved compared with a case in which the time signal is output at all times.

[Fourth Embodiment]

A time measurement system according to a fourth embodiment of the present invention will now be described on the basis of FIGS. 22 and 23.

This embodiment differs from the third embodiment in that (D) the reception timing for the receiver circuit 22 is set by a signal from the divider circuit 15; and, when the receiver circuit 22-receives the motor drive pulse of the slave timepiece 3, the time signal generating circuit 17 is activated to transmit the time signal after a predetermined period of time has elapsed since the reception timing. In other words, whereas, in the third embodiment, the time signal is transmitted after the motor drive pulse is detected, in this embodiment, the time from the detection to the transmission of the time signal is adjustable.

Since the configuration of the slave timepiece 3 and a flowchart showing a process by the slave timepiece 3 are the same as those in the third embodiment, descriptions thereof are omitted.

Figure 22:
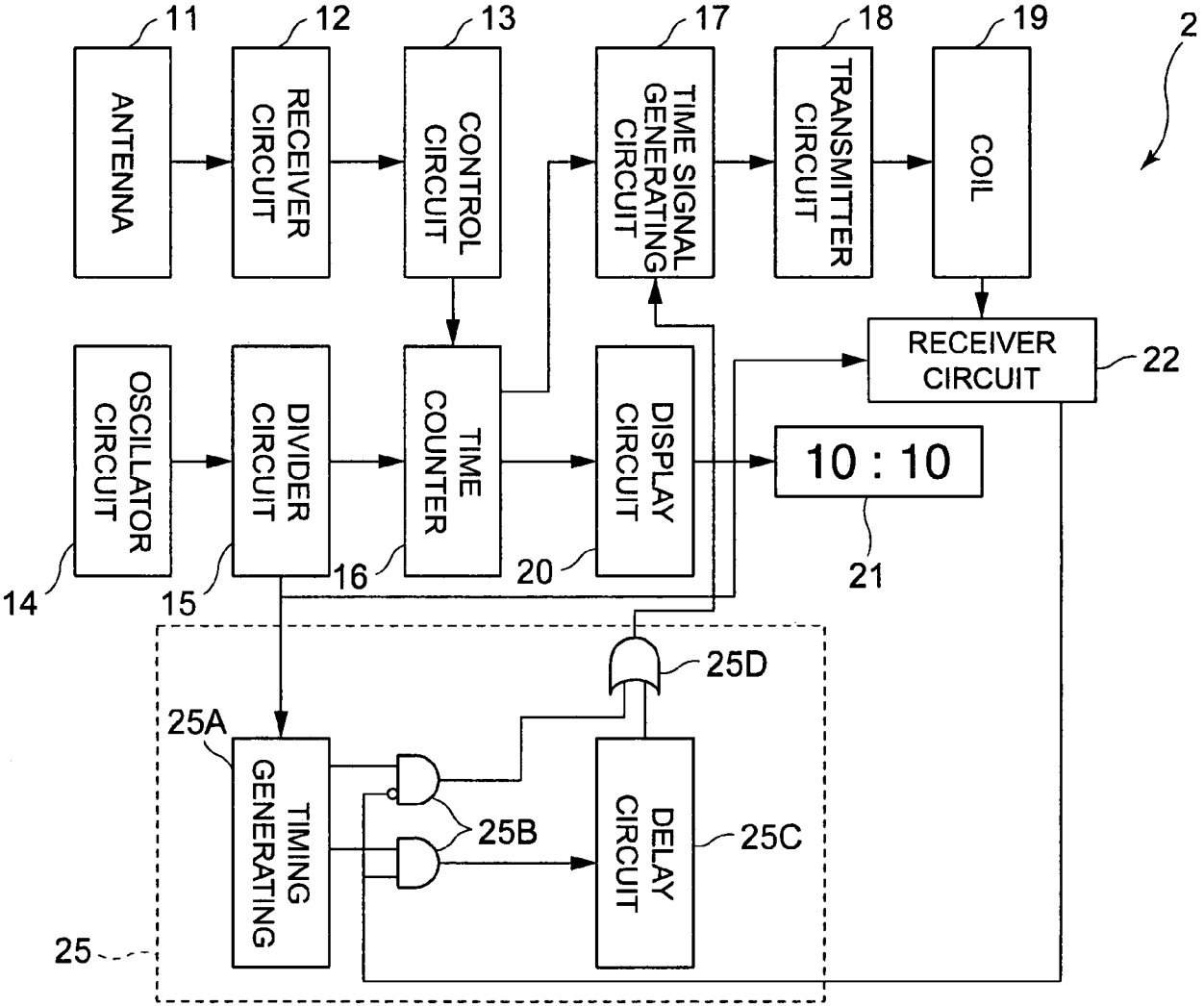
FIG. 22 is a block diagram showing the configuration of a master timepiece according to a fourth embodiment of the present invention.
Figure 23:
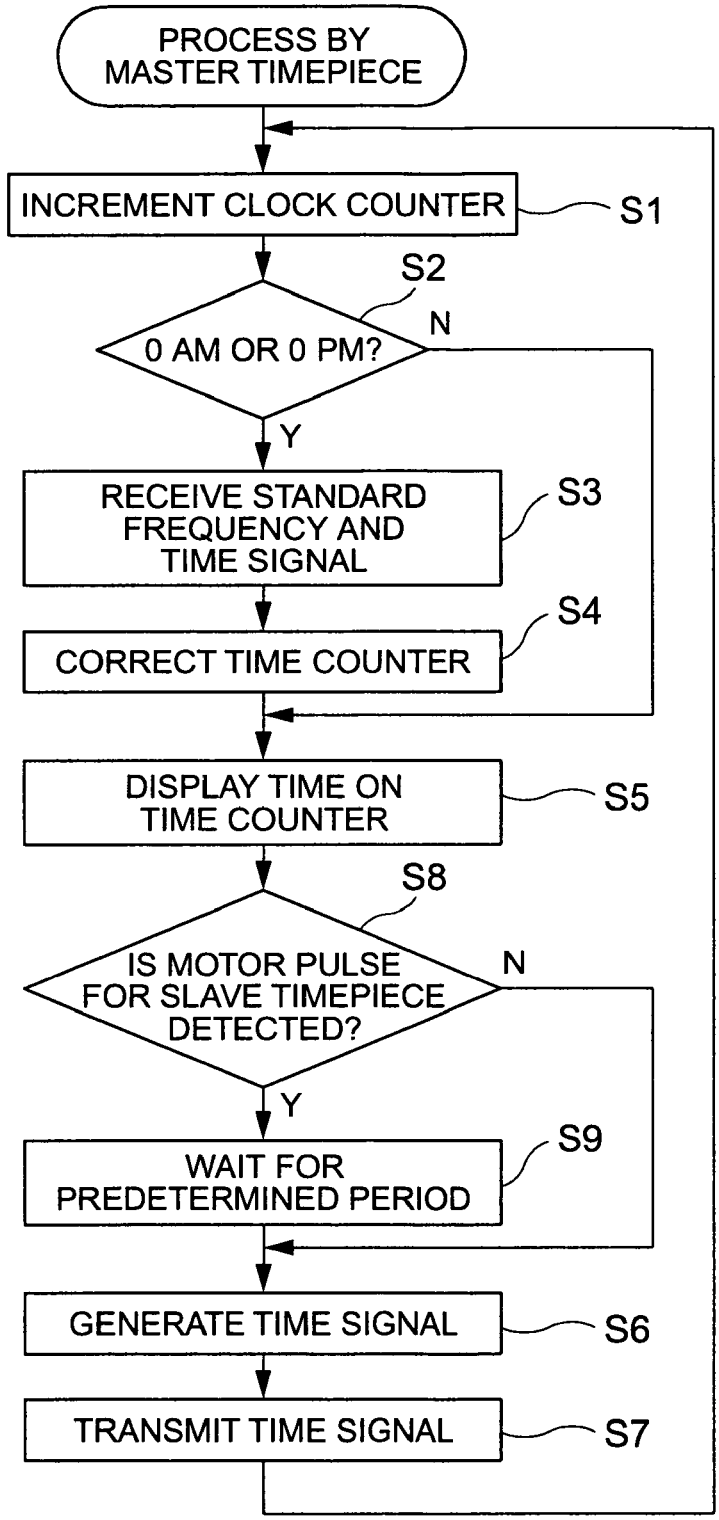
FIG. 23 is a flowchart showing the operation of the master timepiece of the fourth embodiment.

As shown in FIG. 22, the master timepiece 2 includes, as in the third embodiment, the antenna 11, the receiver circuit 12 serving as the time data receiver, the control circuit 13, the oscillator circuit 14, the divider circuit 15, the time counter 16, the time signal generating circuit 17, the transmitter circuit 18, the coil 19, the display circuit 20, the time display unit 21, and the receiver circuit 22. In addition, the master timepiece 2 includes a transmission timing setting circuit 25.

The transmission timing setting circuit 25 includes a timing generating circuit 25A that generates a predetermined timing signal using a signal from the divider circuit 15; two AND circuits 25B connected to the timing generating circuit 25A and the receiver circuit 22; a delay circuit 25C that delays an output of one AND circuit 25B by a predetermined time and outputs the delayed output; and an OR circuit 25D connected to the delay circuit 25C and the other AND circuit 25B.

The operation of the master timepiece 2 of the fourth embodiment, which is arranged as described above, will now be described using a flowchart of FIG. 23. The flowchart in FIG. 23 showing a process by the master timepiece 2 is substantially the same as that of the third embodiment shown in FIG. 18. Therefore, the same reference numeral is given to the same processing, and a description thereof is omitted.

Specifically, in this embodiment, it is determined whether or not the motor drive pulse of the slave timepiece 3 is detected (S8). When the motor drive pulse is detected, the transmission timing setting circuit 25 waits for a predetermined period of time (S9). The waiting time can be set by the transmission timing setting circuit 25. For example, the waiting time is set to 200 msec or the like.

In this embodiment, the time signal is transmitted after a predetermined period of time (200 msec or the like) has elapsed since the detection of the motor drive pulse of the slave timepiece 3.

When no motor drive pulse is detected in S8, the time signal is generated (S6) and transmitted (S7) without waiting for the predetermined period of time. Subsequently, the process returns to the time counter incrementing processing (S1). The master timepiece 2 repeats the processing in S1 to S9 in FIG. 18.

According to the fourth embodiment, in addition to the advantages (1) to (6), (11), and (12) of the above-described embodiments, the following advantages are achieved.

(13) Since the transmission timing setting circuit 25 is provided, the time signal is controlled to be output after a predetermined period of time has elapsed since the detection of the motor drive pulse. The time signal is reliably prevented from overlapping the motor drive pulse when being output. The slave timepiece 3 reliably receives the time signal without being hindered by the motor drive pulse.

The time measurement system of the present invention is not limited to the above-described embodiments. Various modifications can be made without departing from the scope of the present invention.

For example, the master station is not limited to the master timepiece 2 displaying time. The master station may not include the display circuit 20 and the time display unit 21 and may only include a function of receiving the time data, such as radio waves, and a function of generating and transmitting the time signal. Such a timepiece without a time display function can be further miniaturized and installed at a place from which the timepiece cannot be seen. Therefore, the freedom of installing the timepiece is increased.

The time data received by the master station is not limited to the LF standard frequency and time signal and may be FM multiple rays or GPS satellite waves. The time data may be associated not only with the LF standard frequency and time signal in Japan, but also with frequency bands used overseas.

The time data receiver of the master station is not limited to a unit that includes an antenna or the like and receives the above-described various radio waves. For example, a time data receiver that receives time data indicating standard time via a wired or wireless network may be used. Alternatively, a time data receiver that is connected to a computer or the like via a serial interface including USB, Bluetooth, or the like and that receives time data from the computer may be used.

The method of transmitting the time signal from the master station is not limited to transmitting the time signal two or three times every second or transmitting the time signal on the basis of the reception of the motor drive pulse as in each embodiment described before. For example, the time signal may be transmitted four times or more every second. The transmission rate may be set accordingly.

The time signal transmitted from the master station to the slave station can be of any type, as long as it can be received by the motor driving coil 35 of the slave station. In other words, the frequency, the signal intensity, and the like of the time signal can be set by taking into consideration the number of turns, the inductance, and the like of the motor driving coil 35.

Means for displaying the reception result by the slave station is not limited to a unit with a liquid crystal display or a unit controlling the movement of the hands 36A. The master station or the slave station may be provided with a lamp or the like for displaying the reception state of the time signal.

Displaying the reception result by controlling the movement of the hands 36A is not limited to two-step hand movement. For example, other hand movement methods, such as a method of moving the hands 36A forward and backward, may be used.

The time display units of the slave station and the master station may be in an analog display format using the hands 36A, a digital display format using a liquid crystal display or the like, or a format combining these two formats. An appropriate format may be selected.

The slave station of the present invention is not limited to the slave timepiece 3 and may include various timepieces, such as a pocket watch, a wall clock, and a stand clock, and timepieces incorporated in various electronic devices, such as a video, a television, and a cellular phone. The driving motor of the slave station is not limited to a motor that drives the hands 36A, and may be provided to drive another driver in a video cassette recorder or the like. In short, the slave station of the present invention is widely applicable to various devices with a motor for driving a driver of some type and a time display unit for displaying time.

The master station of the present invention may be implemented by incorporating a computer with a CPU, a ROM, and a RAM into the master timepiece 2 and installing into the computer a program that causes the computer to function as the receiver circuit 12, the control circuit 13, the time counter 16, the time signal generating circuit 17, and the like.

Similarly, the slave station of the present invention may be implemented by incorporating a computer with a CPU, a ROM, and a RAM into the slave timepiece 3 and installing into the computer a program that causes the computer to function as the time counter 33, the motor driving circuit 34, the control circuit 38, the hand position counter 39, and the like.

With such programs, the master station 2 and the slave timepiece 3 of the above-described embodiments can be implemented by changing the programs.

As has been described above, according to a time measurement system and a method of controlling the same of the present invention, increases in the number of components and cost of the time measurement system including a master station and a slave station can be suppressed. Also, the time can be adjusted within a short period of time, and waterproof abilities of the master station and the slave station are improved.

What is claimed is:

1. A time measurement system comprising a master station that receives external time data and outputs a time signal on the basis of the external time data and a slave station that receives the time signal from the master station and corrects the time on the basis of the external time data, wherein the slave station includes a reference signal generating circuit that generates a reference signal; a timekeeping circuit that keeps time on the basis of the reference signal; a driving motor with a driving coil; a receiver circuit that is connected to the driving coil and that receives the time signal using the driving coil as a receiving coil; a control circuit that corrects the time kept by the timekeeping circuit on the basis of the time signal received by the receiver circuit; and a time display unit that displays the time kept by the timekeeping circuit, and wherein the master station includes a time data receiver that receives the external time data; a time signal generating circuit that generates a time signal on the basis of the received time data, the time signal being receivable by the driving coil of the slave station; a transmitter circuit and a communication coil that transmit the time signal; and a control circuit that controls the operation of the time data receiver, the time signal generating circuit, and the transmitter circuit; and the master station further including a transmission timing setting circuit; and wherein the control circuit of the master station controls the transmission timing setting circuit to set a transmission time of the time signal so that it does not overlap a time at which a motor drive pulse of the slave station is output.

2. The time measurement system according to claim 1, wherein the time data receiver of the master station includes a receiver circuit that receives radio waves including a time code, the external time data being time data based on the time code included in the radio waves.

3. The time measurement system according to claim 1, wherein the time display unit of the slave station includes time-displaying hands connected to the driving motor via a gear train, the driving motor being driven by a motor driving circuit that outputs a motor drive pulse in response to the timekeeping by the timekeeping circuit.

4. The time measurement system according to claim 1, wherein the slave station includes a transmitter circuit that is connected to the driving coil and that transmits a signal using the driving coil as a transmitting coil; and a control circuit that controls the transmitter circuit to transmit, via the driving coil, a receipt acknowledgement signal indicating that the time signal is received by the receiver circuit, and wherein the master station includes a receiver circuit connected to the communication coil; a reception result displaying unit; and a control circuit that controls the reception result displaying unit to perform predetermined display when the receipt acknowledgement signal from the slave station is received by the receiver circuit.

5. The time measurement system according to claim 4, wherein the reception result displaying unit includes hands, and the control circuit controls the hands to display the reception result by driving the hands to move differently from normal hand movement.

6. The time measurement system according to claim 4, wherein the reception result displaying unit includes a liquid crystal display, and the control circuit controls the liquid crystal display to display a predetermined symbol representing the reception result.

7. The time measurement system according to claim 1, wherein the slave station includes a reception result displaying unit; and a control circuit that controls the reception result displaying unit to perform predetermined display when the time signal is received by the receiver circuit.

8. The time measurement system according to claim 7, wherein the reception result displaying unit includes a liquid crystal display, and the control circuit controls liquid crystal display to display a predetermined symbol representing the reception result.

9. The time measurement system according to claim 7, wherein the reception result displaying unit includes hands, and the control circuit controls the hands display the reception result by driving the hands to move differently from normal hand movement.

10. The time measurement system according to claim 1, wherein the master station includes a switch, and the control circuit of the master station controls the transmitter circuit to transmit the time signal only when the switch is turned on.

11. The time measurement system according to claim 1, wherein the slave station includes a switch, and the control circuit of the slave station controls the receiver circuit to receive the time signal only when the switch is turned on.

12. The time measurement system according to claim 1, wherein the control circuit of the master station controls the transmitter circuit to transmit the time signal twice or more every second, the transmission interval between the time signals being greater than or equal to the pulse width of the motor drive pulse of the slave station.

13. The time measurement system according to claim 1, wherein the control circuit of the master station controls the transmitter circuit to transmit the time signal three times or more every second.

14. A method of controlling a time measurement system including a master station and a slave station, comprising:

receiving, by the master station, external time data;

generating a time signal on the basis of the time data received in the receiving step, the time signal being receivable by a driving coil of a driving motor of the slave station;

detecting, by the master station, a motor drive pulse of the slave station;

transmitting the time signal from a communication coil of the master station and controlling, by the master station, a transmission time of the time signal so that it does not overlap a time at which a motor drive pulse of the slave station is output;

receiving the time signal using the driving coil of the slave station; and correcting time kept by the slave station on the basis of the received time signal.

* * * * *